US006585509B2

(12) United States Patent
Young et al.

(10) Patent No.: US 6,585,509 B2
(45) **Date of Patent: *Jul. 1, 2003**

(54) VAPORIZATION AND PRESSURIZATION OF LIQUID IN A POROUS MATERIAL

(75) Inventors: Thomas M. Young, Richmond, CA (US); Niels O. Young, deceased, late of San Rafael, CA (US); by Lucy J. Young, Thetford Hill, VT (US)

(73) Assignee: Allports LLC International, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/079,636

(22) Filed: Feb. 19, 2002

(65) Prior Publication Data

US 2002/0086253 A1 Jul. 4, 2002

Related U.S. Application Data

(63) Continuation-in-part of application No. 09/654,659, filed on Sep. 5, 2000, now Pat. No. 6,347,936, which is a continuation of application No. 08/899,181, filed on Jul. 23, 1997, now Pat. No. 6,162,046, which is a continuation-in-part of application No. 08/439,093, filed on May 10, 1995, now Pat. No. 5,692,095.

(51) Int. Cl.[7] ..... F23D 11/44; F23L 15/00

(52) U.S. Cl. ..... 431/11; 431/208; 431/241

(58) Field of Search ..... 431/208, 32, 11, 431/206, 243, 102, 344, 241, 259; 123/549; 126/40, 45–47, 96

(56) References Cited

U.S. PATENT DOCUMENTS 799,581 A * 9/1905 Trewhella et al. ..... 431/241
1,225,381 A * 5/1917 Wedge et al. ..... 431/328
1,905,610 A * 4/1933 Stoll ..... 431/208
1,944,821 A * 1/1934 Blaise et al. ..... 167/3
3,234,928 A * 2/1966 Smith ..... 123/142.5
3,262,290 A * 7/1966 Huber ..... 67/55
3,663,152 A * 5/1972 Yoshida ..... 431/344
3,869,242 A * 3/1975 Schladitz ..... 431/208
3,914,096 A 10/1975 Schladitz ..... 431/208
4,134,718 A * 1/1979 Kayfetz et al. ..... 431/125

(List continued on next page.)

OTHER PUBLICATIONS

Los Alamos National Library, "How to Make a Supercritical Fluid," Supercritical Fluids Facility Website pages, http://scrub.lanl/gov/make.htm (Aug. 19, 1999).

van Bommel, M.J., et al., "Drying of Silica Gels With Supercritical Carbon Dioxide," *Journal of Materials Science*, vol. 29, pp. 943–948 (1994).

Androff, Nancy Wara et al., "Macroporous Ceramics from Ceramic–Polymer Dispersion Methods," *Ceramics Processing*, vol. 43, No. 11A (1997).

(List continued on next page.)

*Primary Examiner*—James C. Yeung
(74) *Attorney, Agent, or Firm*—Ann W. Speckman

(57) ABSTRACT

A vaporization module is provided that includes a capillary member to convert non-pressurized liquid to pressurized vapor. The pressure is sustained by capillary pressure of the liquid in the capillary member. The capillary member has low thermal conductivity and small-sized pores that permits liquid to travel by capillary action toward the vaporization zone. Often, the pores of the capillary member are substantially uniform in size. The capillary member may comprise ceramic material. The module also includes an orifice plate that has one or more orifices to permit release of pressurized vapor, e.g. as a pressurized vapor jet. The orifice plate is associated with a sealing member to form an at least partial enclosure of the module so that vapor may accumulate and pressure may be increased within the module. In addition, other aspects of the present invention relating to the vaporization and pressurization of liquid are described.

14 Claims, 20 Drawing Sheets

U.S. PATENT DOCUMENTS

| | | | | | |
|---|---|---|---|---|---|
| 4,193,755 | A | * | 3/1980 | Guarnaschelli et al. | 431/207 |
| 4,318,689 | A | * | 3/1982 | Forster et al. | 431/208 |
| 4,365,952 | A | * | 12/1982 | Ohmukai et al. | 431/208 |
| 4,421,477 | A | | 12/1983 | Adachi et al. | 431/325 |
| 4,552,124 | A | * | 11/1985 | Nakajima | 126/413 |
| 4,571,481 | A | * | 2/1986 | Leary | 431/208 X |
| 4,652,411 | A | | 3/1987 | Swarr et al. | 264/43 |
| 4,684,341 | A | * | 8/1987 | Kawamura et al. | 273/12.3 C |
| 4,703,888 | A | * | 11/1987 | Kawamura et al. | 273/12.3 C |
| 4,966,742 | A | | 10/1990 | Khoury et al. | 264/166 |
| 5,002,710 | A | | 3/1991 | Shanefield et al. | 264/63 |
| 5,093,289 | A | | 3/1992 | Braetsch et al. | 501/80 |
| 5,113,478 | A | * | 5/1992 | Nakashima et al. | 431/208 |
| 5,197,871 | A | | 3/1993 | Yamamoto et al. | 431/262 |
| 5,222,186 | A | | 6/1993 | Schimanski et al. | 392/395 |
| 5,273,692 | A | | 12/1993 | Numoto et al. | 264/26 |
| 5,298,205 | A | | 3/1994 | Hayes et al. | 264/59 |
| 5,484,086 | A | * | 1/1996 | Pu | 222/187 |
| 5,563,106 | A | | 10/1996 | Binner et al. | 501/84 |
| 5,683,797 | A | | 11/1997 | Carolan et al. | 428/307 |
| 5,692,095 | A | * | 11/1997 | Young | 392/395 |
| 5,705,118 | A | | 1/1998 | Hayes et al. | 264/432 |
| 5,830,548 | A | | 11/1998 | Andersen et al. | 428/36.4 |
| 5,849,650 | A | | 12/1998 | Rorabaugh et al. | 501/80 |
| 5,870,525 | A | | 2/1999 | Young | 392/395 |
| 5,881,353 | A | | 3/1999 | Kamigata et al. | 419/2 |
| 5,902,759 | A | | 5/1999 | Dismukes et al. | 501/80 |
| 5,910,462 | A | | 6/1999 | Gani et al. | 501/80 |
| 6,162,046 | A | * | 12/2000 | Young et al. | 431/11 |
| 6,347,936 | B1 | | 2/2002 | Young et al. | 431/11 |

OTHER PUBLICATIONS

Androff, Nancy Wara et al., "Macroporous Ceramics from Ceramic–Polymer Dispersion Methods," *AIChE Journal*, vol. 43, No. 11A, pp. 2878–2888 (1997).

van Bommel, M.J. et al, "Drying of Silica Gels with Supercritical Carbon Dioxide," *Journal of Materials Science*, vol. 29, pp. 943–948 (1994).

Miaoulis, Ioannis N. et al., "Thermal Energy Storage with Reversible Hydration of Lithium Bromide," *HTD* vol. 206–2, *Topics in Heat Transfer*—vol. 2, pp. 125–129.

* cited by examiner

Fig. 7b
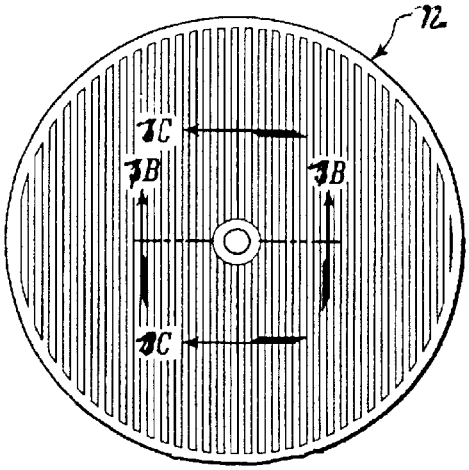
Fig. 7a
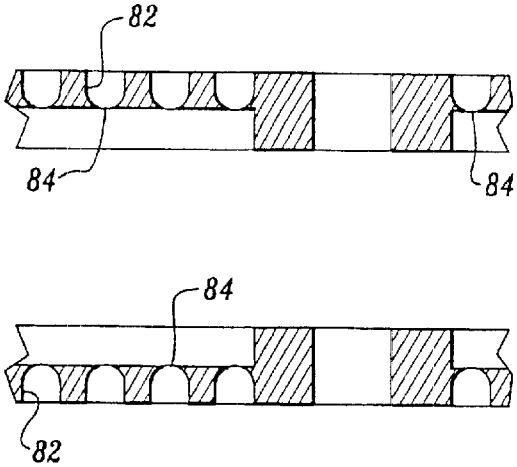
Fig. 7c

VAPORIZATION AND PRESSURIZATION OF LIQUID IN A POROUS MATERIAL

CROSS REFERENCE TO RELATED APPLICATIONS

This application is a continuation-in-part of U.S. patent application Ser. No. 09/654,659, filed Sep. 5, 2000, and now issued as U.S. Pat. No. 6,347,936 which is a continuation of U.S. patent application Ser. No. 08/899,181, filed Jul. 23, 1997, now issued as U.S. Pat. No. 6,162,046, which is a continuation-in-part of U.S. patent application Ser. No. 08/439,093, filed May 10, 1995, now issued as U.S. Pat. No. 5,692,095, all of which are incorporated herein by reference.

FIELD OF THE INVENTION

The present invention relates to vaporization and pressurization of liquid in a capillary material, and relates particularly to formation of a pressurized vapor emission from a non-pressurized liquid source.

BACKGROUND

Conventional boilers add heat to a reservoir or inflow of liquid to convert the liquid to vapor. To sustain the inflow of liquid in a pressurized boiler system, the liquid must be supplied under at least as much pressure as that of the outgoing vapor. In a typical industrial boiler, the liquid is pumped into the boiler according to the desired vapor pressure. A throttle controls the flow of vapor from the boiler and, correspondingly, the vapor pressure within the boiler. Feed pumps supply water to the boiler according to the vapor pressure to maintain a constant liquid level in the boiler. If the vapor pressure is increased by reducing flow through the throttle, then the pumping pressure is decreased to maintain the level of liquid in the boiler. Usually, the throttle is operatively coupled to the feed pump(s) so that the pumping pressure is automatically adjusted according to the flow through the throttle and, correspondingly, the vapor pressure in the boiler. This mechanism of automatically controlling the performance of the feed pumps is commonly referred to as a servomechanism.

In most liquid fuel vaporization applications, liquid fuel is vaporized, then mixed with air or an oxygen-containing gas, and the vaporized fuel/gas mixture is ignited and burned. The liquid fuel is generally supplied under pressure, and vaporized by mechanical means or heated to vaporization temperatures using an external energy source.

Portable burners and light sources that utilize liquid fuels generate liquid fuel vapor, which is then mixed with air and combusted. Combustion devices that burn fuels that are liquids at atmospheric temperatures and pressures, such as gasoline, diesel fuel and kerosene, generally require the liquid fuel to be pressurized by a pump or other device to provide vaporized fuel under pressure. Fuels such as propane and butane, which are gases at atmospheric pressures but liquids at elevated pressures, can also be used in portable burners and light sources. Storage of these fuels in a liquid form necessitates the use of pressurized fuel canisters that are inconvenient to use and transport, are frequently heavy, may be explosion hazards, and require valves, which are prone to leaking.

The fuel boiler of propane and butane burners is the reservoir or storage tank itself, from which the gases are released under pressure as vapor. When vapor is withdrawn from the fuel reservoir, the pressurized reservoir acts as a boiler, and draws the required heat of vaporization from ambient air outside the tank. These systems have many disadvantages. The vapor pressure of propane inconveniently depends upon ambient temperature, and the vapor pressure is generally higher than that needed for satisfactory combustion in a burner. While butane fuel has an advantageous lower vapor pressure than propane, burners using butane have difficulty producing sufficient vapor pressure at low ambient temperatures. Burners using a mixture of propane and butane fuel provided under pressure in disposable canisters have also been developed. This fuel mixture performs well at high altitudes, but still does not perform well at low ambient temperatures.

A needle valve can be used to control propane vapor at tank pressure to regulate the fuel flow, and thus the heat output, of a burner. Burner control using a needle valve tends to be delicate and sensitive to ambient temperatures. Alternatively, a pressure regulator can be used to generate a constant and less hazardous pressure of propane that is independent of tank temperature. Propane pressure regulators are commonly used in outdoor grills, appliances for recreational vehicles and boats, and domestic propane installations. Unfortunately, regulators are bulky and are seldom practical for application to small-scale portable burner devices.

Despite considerable development efforts and the high market demand for burners for use in stoves, lamps and the like, that operate safely and reliably under a wide variety of ambient temperature, pressure and weather conditions, commercially available combustion devices are generally unsatisfactory.

Wicking systems that use capillary action to convey and vaporize liquid fuels at atmospheric pressure are known for use in liquid fuel burners. U.S. Pat. No. 3,262,290, for example, discloses a liquid fuel burner in which a wick stone is fastened in a fuel storage container and feeds liquid fuel from the fuel reservoir to the burner. In this system, liquid fuel is provided to the wick stone by an absorbent textile wick, and the wick stone is biased against a burner wick.

U.S. Pat. No. 4,365,952 discloses a liquid fuel burner in which liquid fuel is drawn up from a reservoir by a porous member having a fuel receiving section and a fuel evaporation section. Liquid fuel is supplied by capillary action at a rate matching the rate of evaporation of the fuel. Air is supplied to the fuel evaporation section, and liquid fuel is evaporated from the surface at a rate corresponding to the rate of air supply. The gaseous fuel and air is mixed and jetted from a flame section to a burning section. An externally powered heater maintains the porous member of the fuel evaporation section substantially at a constant temperature irrespective of the rate of evaporation of the liquid fuel.

U.S. Pat. No. 4,421,477 discloses a combustion wick comprising a fuel absorption and a fuel gasifying portion designed to reduce the formation and deposition of tar-like substances in the wick. The wick comprises silica-alumina ceramic fibers molded with an organic binder, with part of the wick provided with a coating of an inorganic pigment, silicic anhydride and a surface active agent. The wick may have a capillary bore size of about 1 to 50 microns, with smaller pore size wicks being less prone to accumulation of tar-like substances on the inside.

U.S. Pat. No. 4,465,458 discloses a liquid fuel combustion system in which the liquid fuel is drawn into a porous fiber material or fabric, which is intimately contacted by an externally powered heat generating member to evaporate and vaporize the liquid fuel. Air is introduced to promote vaporization of the liquid fuel and provide an admixed liquid/fuel mixture for burning. Combustion is variable by adjusting the heat input and the air supply.

U.S. Pat. No. 4,318,689 discloses a burner system in which liquid fuel is pumped into a cylindrical chamber having a porous sidewall. As a result of the pressure differential, the liquid fuel penetrates the porous wall to form a film on the external surface of the porous chamber wall. Preheated combustion air entrains and vaporizes the liquid fuel film formed on the external wall of the chamber, and circulates the fuel/air mixture to a combustion chamber. A portion of the hot exhaust or combustion gases may be returned for countercurrent heat exchange to preheat the combustion air.

Although the prior art discloses numerous types of liquid fuel combustion systems, most liquid fuel vaporizers require the application of energy from an external source, such as heat energy, pressure for pressurizing the liquid fuel and/or vapor, or a blower for jetting an air stream to entrain the vaporized fuel for burning. Prior art liquid fuel combustion systems generally provide vaporization of liquid fuels at atmospheric pressures or, if a pressurized vapor stream is desired, either require the fuel supply to be pressurized or pressurize the vapor by external means. Many of the systems are complex and are not suitable for liquid fuel combustion apparatus that are robust, portable or that are suitable for small scale heating or lighting applications.

SUMMARY

The vaporization module of the present invention includes a capillary member to convert liquid to vapor in a vaporization zone. The capillary member has low thermal conductivity and small-sized pores that permits liquid to travel by capillary action toward the vaporization zone. Often, the pores of the capillary member are substantially uniform in size. The capillary member may comprise ceramic material. The module also includes an orifice plate that has one or more orifices to permit release of pressurized vapor, e.g. as a pressurized vapor jet. The orifice plate is associated with a sealing member to form an at least partial enclosure of the module so that vapor may accumulate and pressure may be increased within the module. This pressure is sustained by the capillary pressure of the liquid in the capillary member.

In some embodiments, the vaporization module may include a liquid feed member, which may be porous, to provide liquid to the capillary member. Usually the liquid is non-pressurized, e.g. at atmospheric pressure, when introduced to the module. The vaporization module may also include a heat transfer member, which may be porous, to provide heat to the capillary member and in particular, to the vaporization zone. Oftentimes, a thermal gradient is formed between the vaporization zone and the liquid feed member.

Furthermore, some embodiments of the vaporization module include various control mechanisms. For example, a vapor collection space to accumulate vapor and increase pressure may be provided. Such vapor collection space may be formed by the sealing member being positioned away from the capillary member. In addition, the module may have a valve or throttle to regulate the release of vapor. At times, a burner assembly may be provided, for example, in liquid fuel combustion applications to facilitate mixing of gases, e.g. fuel vapors, to form a combustible mixture.

The vaporization module produces pressurized vapor by a method including providing liquid and heat to the vaporization zone. Usually the providing of heat and liquid occurs simultaneously, however, either component may also be provided before the other. At the vaporization zone, the heat is at the liquid vaporization temperature. The resulting vapor is allowed to accumulate in order to build pressure to the desired amount. The pressurized vapor is released from the vaporization module, such as through one or more orifices. Oftentimes, the vapor has a greater pressure than the provided liquid. In some embodiments, the vapor is released with sufficient velocity to mix with air.

The method of making pressurized vapor according to the present invention may be relevant to various fields in which pressurized vapor is desired. In one such field, the released vapor serves as fuel for combustion. In this case, the capillary member may initially acquire heat, such as through an external source, and then the continued source of heat may be from heat of the combustion returned to the module.

An apparatus may incorporate a single module or a plurality of individual vaporization modules, such as in applications requiring more vapor, higher heat or light output than a single module can provide. In addition, modules having different capacities may be arrayed together for use separately or in combination.

BRIEF DESCRIPTION OF THE DRAWINGS

The present invention is illustrated by way of example in the figures of the accompanying drawings and are not intended for limitation, in which:

FIGS. 7A to 7C show various views of a heat transfer member, wherein FIG. 7A illustrates an enlarged plan view, FIG. 7B illustrates a cross-sectional view taken along line 5B—5B of FIG. 7A, and FIG. 7C illustrates a cross-sectional view taken along line 5C—5C of FIG. 7A.

DETAILED DESCRIPTION

A vaporization module for producing an emission of pressurized vapor is provided. The vaporization module includes a capillary member to transform liquid into vapor at a vaporization zone. The vaporization zone is formed within or on the surface of the capillary member by heat migrating through the capillary member toward a liquid feed member and liquid being drawn by capillary forces into the capillary member and toward the vaporization zone. A sealing member at least partially encloses, and usually substantially encloses, the module and allows vapor pressure to build within the module. The resulting vapor is released under pressure from the module through one or more orifices. In this manner, a pressurized liquid source is not required in order to form pressurized vapor.

Figure 1:
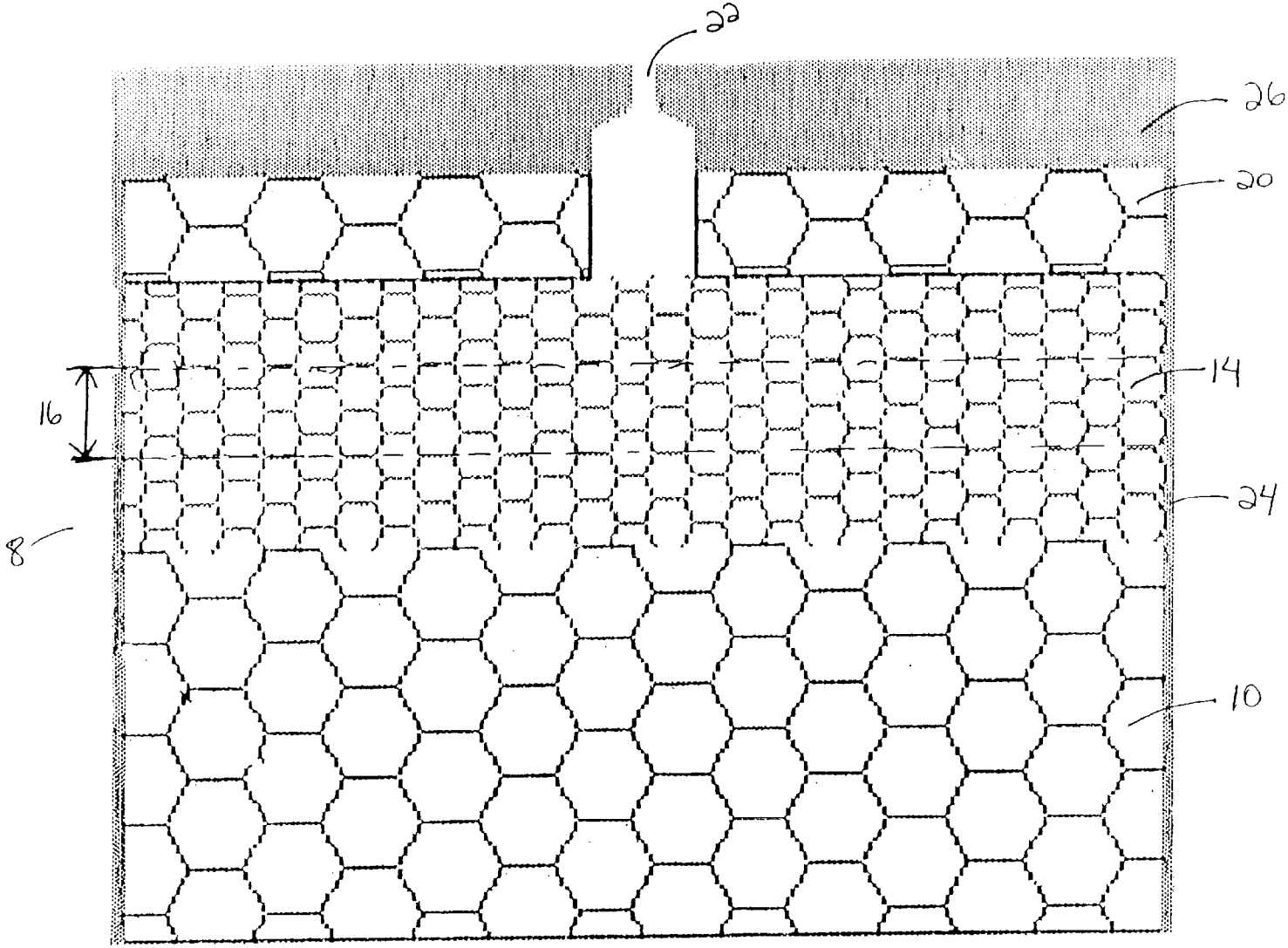
FIG. 1 shows a schematic cross-sectional diagram illustrating a vaporization module of the present invention having individual porous sections, according to one embodiment of the present invention.

One embodiment of the vaporization module 8 of the present invention is shown in FIG. 1 as a stack of individual module members. Vaporization module 8 comprises a capillary member 14, a liquid feed member 10 to provide liquid to the capillary member 14, a heat transfer member 20 to provide heat to the capillary member 14, and an orifice plate 26 to permit vapor produced by the capillary member 14 to be released. At least the liquid feed member 10, capillary member 14 and heat transfer member 20 are highly permeable to liquids and vapors and are sealed at their peripheral edges by sealing member 24, which is substantially impervious to liquids and vapors.

Liquid feed member 10, capillary member 14, heat transfer member 20 and orifice plate 26 may be substantially aligned to provide a vaporization module. Surfaces of the individual module members may be in close proximity to one another, and may be in contact with one another. A variety of polygonal configurations are suitable for various applications. A circular configuration for each of the members may provide a module having a cylindrical three-dimensional configuration. The relative thickness of the various elements may vary, depending on the materials of construction, the desired properties, and the vaporization module application.

One or more capillary members 14 are provided as highly porous and low thermal conductivity material. The pores are small and at least substantially uniform in size with an open structure providing high bubble pressure. Although capillary member is depicted as cylindrical in shape, the capillary member may also be provided in a variety of other shapes, sizes and configurations.

The capillary member includes a vaporization zone where at least most of the vapor is created from liquid. The temperature of the vaporization zone is at the vaporization temperature for the liquid provided to be converted into vapor. Typically, the location of the vaporization zone may be stabilized through counter balance of heat and vapor accumulation pressing toward the liquid feed surface and the liquid traveling by capillary action.

The pores of the capillary member 14 are sized to create an open structure for the liquid to flow via capillary action through the length of the capillary. The pore size typically remains substantially constant during operation of the vaporization module. The capillary member may have any amount of porosity to produce the desired volume of vapor and rate of vaporization. A percentage porosity from about 45% to 90% is typical and more often between 60% to 80%.

Figure 2:
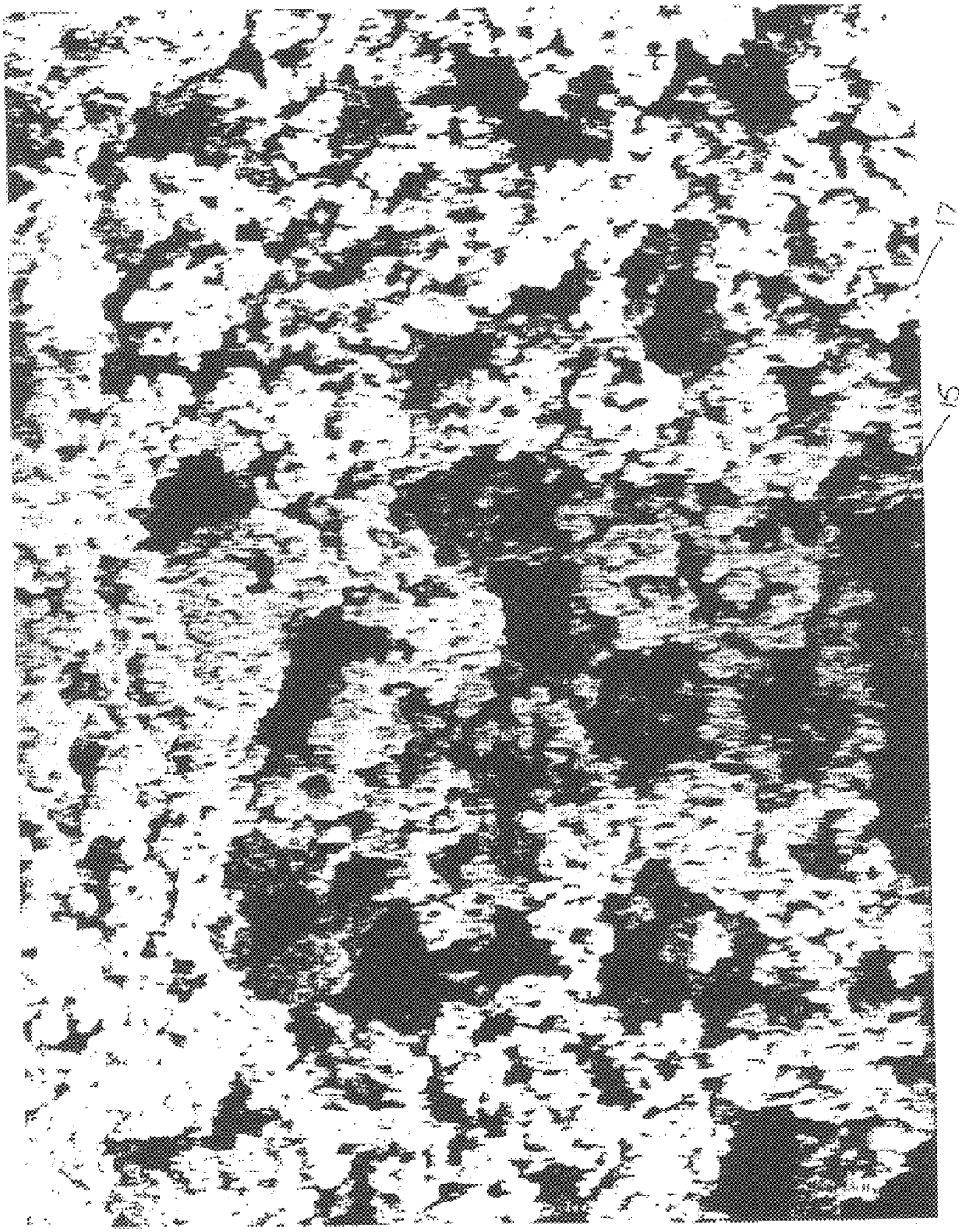
FIG. 2 shows an electron micrograph of the porous structures of the capillary member of the present invention.

An example of a capillary member with pore structures according to the present invention is depicted in an electron micrograph in FIG. 2. In the embodiment shown, the porous structures 15 extend to the surface 17 of the capillary member, such that fluid may flow through the entire capillary member 14.

The pore size may be smaller where it is desirable to generate greater capillary pressures and, consequently, higher evolved vapor pressures. The pore size of capillary member 14 is sufficiently small to provide an adequate supply of liquid to the vaporization zone to produce the desired vapor output and to provide the capillary forces necessary to maintain a discrete vaporization zone and at the same time, provide a porous environment for vaporization to occur in the vaporization zone. For example, an average pore size may be in a range from less than 1.0 micron to about 50.0 microns, and from 0.01 to 10 microns is more typical, and about 0.05 to 2.0 microns is especially typical.

The porous structures within the capillary member 14 are often substantially uniform in size. Non-uniformity of the pore structure may cause reflux turbulence of heat transport towards the liquid feed surface within the capillary member. As a result, higher fluid flow may be required to maintain cooling proximal to the liquid feed surface. Uniform porous structures promote uniform flow through the capillary member, and may permit more controlled output of vapor.

The capillary member also usually has a sufficiently low thermal conductivity to maintain a thermal gradient from the temperature of liquid feed surface 12, e.g. ambient temperature, to the temperature of vaporization at vaporization zone 16. In addition, the amount of thermal conductivity of the capillary member may prevent substantial heat transfer out of vaporization zone 16. Furthermore, the thermal conductance may permit liquid flowing from the feed surface to maintain a low temperature proximal the feed surface. Materials having a thermal conductivity of less than about 10 W/m K are often suitable for capillary member 14, materials having a thermal conductivity of less than about 1.0 W/m K are typical, and materials having a thermal conductivity of less than about 0.10 W/m K are often used.

The material comprising the capillary member has a sufficient porosity to provide an adequate supply of liquid to the vaporization zone to provide the desired vapor output. The capillary member often comprises a ceramic material, such as zirconia and other ceramics having low thermal conductivity. In general, unstabilized zirconias have lower thermal conductivities than stabilized zirconias, and consequently may be used as raw materials for the capillary member. During processing of unstabilized zirconia, raw material ceramics using methods of the present invention, the unstabilized zirconia may become stabilized. Stabilized zirconia materials having lower thermal conductivities, including partially stabilized zirconia (PSZ), tetragonal zirconia (TTZ), and zirconia ceramics stabilized with yttria, magnesia, ceria or calcia, or a combination of stabilizing materials, may also be suitable as raw materials.

In another embodiment, the capillary member 14 comprises a ceramic material having a higher thermal conductivity, such as alumina. Numerous other materials, composite materials may be used in the high porosity material of the present invention. Materials may include glass, especially for a ternary phase system in which a binder and glass particles have a good affinity for each other. Fibrous materials such as fiberglass mats, other types of woven and non-woven fibrous materials, and porous ceramic, low conductivity porous or fibrous metallic materials and porous metal/ceramic composites may also be suitable. Many suitable materials may be commercially available.

Capillary member 14 may alternatively comprise a composite member composed of materials having different thermal conductivities and pore sizes. Such a composite capillary member may, for example, comprise a vaporization member having a generally high thermal conductivity in fluid communication with a liquid transfer member, described below, having a generally low thermal conductivity. The liquid transfer member in this embodiment may serve as a liquid feed system for the vaporization module and the capillary member 14 may incorporate the liquid feed system. In other embodiment, the capillary member may be provided integrally with a liquid feed system.

The capillary member 14 usually receives liquid at a liquid feed surface 12 used in the vaporization. The liquid feed surface 12 may be in fluidic communication with a liquid feed member. While the liquid feed surface 12 is illustrated in FIG. 1 as the "bottom" surface area of capillary member, in other embodiments the liquid feed surface may be provided in a variety of configurations as well as locations within or on the surface area of the capillary member.

Liquid may be provided to the liquid feed surface of the capillary member via a liquid feed member 10. In one embodiment, liquid feed member 10 may deliver a continuous supply of liquid to the liquid feed surface 12. Oftentimes, the liquid is provided at general ambient temperatures and/or pressures to the liquid feed surface.

The liquid feed system may use any mechanism to convey liquid, such as a gravity-fed system, or a capillary feed system employing a porous capillary feed wick or capillary tube(s) or other such systems may transport liquid from a reservoir to the liquid feed surface of the capillary member. In one embodiment, the liquid feed member 10 may include pore structures that permit flow of liquid. However, in other embodiments, the liquid feed member may not have such pores. In embodiments that include a porous liquid feed member, the pore diameter depends upon, inter alia, the materials employed and the general module configuration. An average pore diameter of from about 5 to 150$\mu$ may be generally suitable, and average pore diameter of from about 25 to 75$\mu$ may be more typical. The porosity is often sufficient to allow for unrestricted fluid flow. In addition, the liquid feed member may have high thermal conductivity to maintain a uniform temperature distribution across the liquid feed surface 12. Some suitable high porosity materials for the liquid feed member include ceramics, such as alumina grindstone material (as provided, for example, by Abrasives Unlimited Inc., located in San Leandro, Calif.). The liquid fuel feed system may be provided as an integral component of the vaporization module for certain applications.

The liquid that is used by the vaporization module may be any liquid that may be converted into vapor. For example, a variety of liquid fuels may be vaporized, including fuels such as gasoline, white gas, diesel fuel, kerosene, JP8, alcohols such as ethanol and isopropanol, biodiesel, and combinations of liquid fuels. The vaporization module of the present invention may be optimized for use with a particular liquid fuel source, or a single vaporization module may be designed for use with multiple liquid fuels.

As liquid fuel is supplied from liquid feed member 10, the liquid is heated as it is conveyed through capillary member 14 by capillary forces. A heat transfer member 20 may optionally be provided to heat the capillary member. In one embodiment, the heat transfer member comprises a high porosity, high thermal conductivity material. The porous type of heat transfer member may also have an open and relatively small and uniform pore structure. The porosity may be sufficient to allow unrestricted fluid flow. For example, an average pore diameter may be from about 5 to 150$\mu$, and from about 25 to 75$\mu$ is more typical. The heat transfer member may be composed of any of a variety of materials. For example, high porosity ceramics and composite materials, such as alumina grindstone material (such as material from Abrasives Unlimited, Inc.) may be used. Heat transfer member 20 may be provided with one or more orifice(s) 22, which may be generally aligned with the orifice(s) 22 provided in orifice plate 26, described in detail below with regard to FIG. 3. With the heating of heat transfer member 20, a thermal gradient is established within capillary member 14, with the hottest areas being in proximity to heat transfer member 20 and the coolest areas being in proximity to liquid feed member 10.

In various embodiments, numerous types of heat sources may be provided in contact with or in thermal communication with heat transfer member or capillary member 14. In one embodiment an internal heat source, such as a resistive heating element electrically connected to a power source may be provided. The heat source may also be from the heat of combustion of the released vapor and returned to the heat transfer member to provide the heat required for additional vaporization. In other embodiments, the heat source may be provided within the vaporization module. Heat source 20 may be capable of providing heat in a generally uniform distribution over a surface or cross section of capillary member 14. These heat sources are described by way of example and are not intended to limit the choices that are or may become available in the field of heaters to provide high temperatures for use by the capillary member.

The vaporization module also includes an orifice plate 26 to permit vapor to be released. The orifice plate 26 is often at least substantially impermeable to liquids and vapors. Orifice plate 26 comprises one or more orifice(s) 22 penetrating the thickness of the plate for vapor emission. The orifices are a sufficient size to permit egress of one or more vapor stream(s) under pressure.

The orifice plate 26 may serve a variety of functions. For example, in one embodiment, it may provide for heat transfer from its top surface to heat transfer member 20. In combination with a sealing member, it may assist in creating a barrier for inhibiting release of vapor and liquids except at the orifice(s). It also provides a mounting flange for mounting of structural components that utilize the emitted vapor, such as burner components.

Orifice plate 26 may comprise a material that has a high thermal conductivity. In addition to having a high thermal conductivity, the material comprising orifice plate 26 may be strong and flat. For example, ceramics that are substantially impermeable to liquids and vapors may be materials of construction for orifice plate 26. In particular, ceramic materials comprising a mixture of alumina and glass, such as alumina with a glass sintering aid, may be used for modules employed in combustion applications. In one embodiment, orifice(s) 22 may be chamfered to provide a larger diameter vapor collection zone in proximity to a smaller diameter vapor release zone.

In one embodiment, the orifice plate may be positioned proximal to or in contact with the heat transfer member 20. In another embodiment, the orifice plate may be positioned in proximity to but spaced a distance from the capillary member 14, e.g. near a vapor release surface of the capillary member, to form a vapor collection space.

The vaporization module is at least partially or substantially enclosed at its peripheral edges by sealing member 20 in association with orifice plate 26. The sealing member may be provided in a variety of configurations and arrangements, depending upon the configuration and composition of capillary member 14 and the environment or application in which the vaporization module is used. The sealing member is arranged to provide substantial constraint of vaporization module, and in particular, the capillary member 14. In some embodiments, the orifice plate is a part of a sealing member at least partially enclosing the capillary member. In other embodiments, the sealing member is sealed to the orifice plate or extends over the orifice plate to provide a liquid-tight, vapor-tight seal. Sealing member 20 may be located in close proximity to peripheral edges of the vaporization module, in contact with those peripheral edges, or other positions to contain the module and permit pressure to build within the module by inhibiting escape of liquid and vapor. The sealing member may isolate the surfaces of capillary member 14. However, in some embodiments, the liquid feed surface 12 of the capillary member is not enclosed by the sealing member.

Various types of sealing materials are suitable. For example, the sealing member may be a low thermal conductivity glaze that seals the peripheral edges and holds the various other module members in place.

Although FIG. 1 demonstrates one layout of members of a vaporization module, the scope of the present invention anticipates vaporization modules having a variety of module members arranged in various fashions with reference to the other members.

Figure 3:
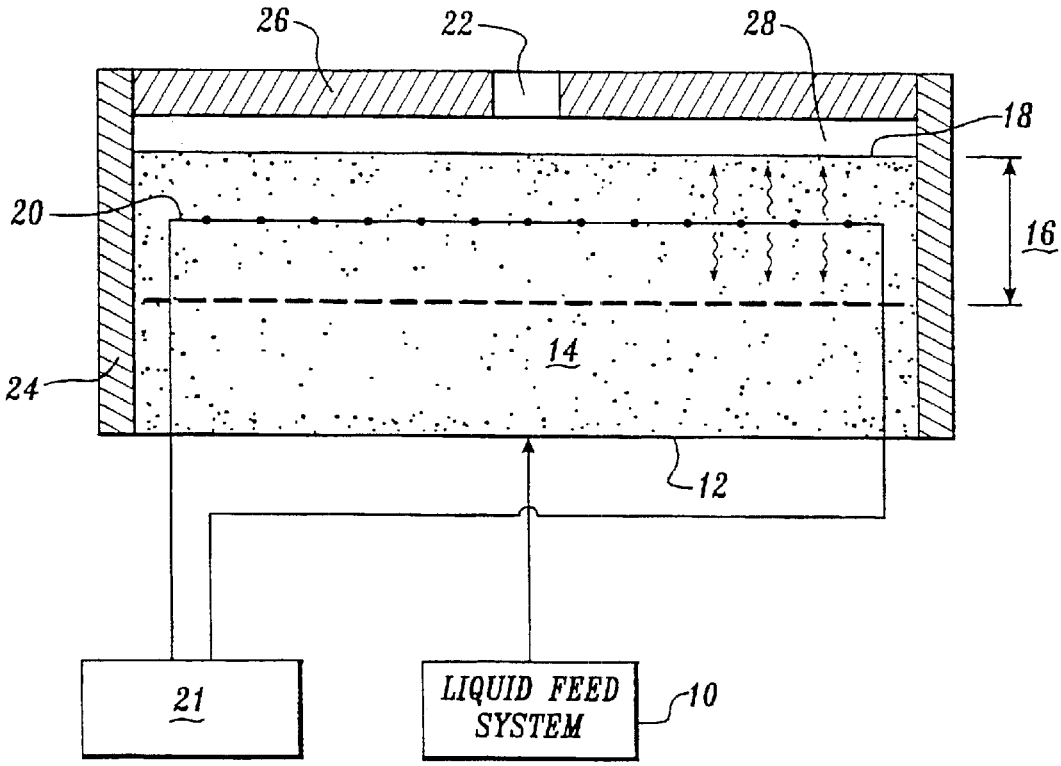
FIG. 3 is a schematic cross-sectional diagram illustrating one embodiment of the vaporization module of the present invention comprising an internal heating element, according to the teachings herein.

In one alternative embodiment of vaporization module illustrated in FIG. 3, a heat source 20 is provided embedded within the capillary member of the module as a resistive heating element in communication with an external power source 21. The power source 21 may permit a controllable amount of heat to be transferred to vaporization zone 16. The resistive heating element may be provided in proximity to vaporization zone 16 of capillary member 14. In addition, orifice plate 26 is spaced away from the capillary member to create a vapor collection space 28 in the gap there between. Produced vapor may collect in the vapor collection space for pressure to increase.

In operation of the vaporization module according to the present invention, liquid at a temperature less than its vaporization temperature and pressure, e.g. ambient temperature, is both vaporized and pressurized in the module to produce one or more pressurized vapor jet(s). The liquid is drawn through capillary member 14 and is heated. At the point where the liquid moves into the vaporization zone 16, which may be on or near the surface of capillary member 14, the liquid is heated to its vaporization temperature and turns into vapor to be released.

In operation of one particular embodiment, liquid feed is continuously introduced to liquid feed surface 12 resulting in a substantially continuous pressurized vapor flow during an operating cycle. The vaporization module may be initiated by activating a heat source 20 and heating the vaporization zone 16. As vaporization zone 16 is heated, a thermal gradient may be established within capillary member 14, with the hottest areas being in proximity to the heat source and vaporization zone, and the coolest areas being in proximity to liquid feed surface 12. Capillary forces convey liquid to vaporization zone 16, where the temperature corresponds to the liquid vaporization temperature. The vaporization zone may be generally a locus of points or layer located at or near vapor release surface 18 of capillary member 14 and is at least partially within capillary member 14.

As the vaporization zone is heated and vapor is generated, vapor pressure may accumulate within the enclosed space formed by the substantially vapor sealing member. Vapor is released, as a pressurized vapor jet, from one or more vapor permeable passages, such as orifice 22. The accumulation of vapor and heat may promote migration of the vaporization zone "downwardly" through capillary member 14 toward liquid feed surface 12. Simultaneously, capillary forces draw ambient temperature and pressure liquid into the capillary member at liquid feed surface 12 and toward the vaporization zone, thus this counterbalance stabilizes the location of the vaporization zone. Vapor may be produced on surfaces of and/or within capillary member 14 and vapor exits capillary member 14 at vapor release surface 18. The produced vapor is pressurized within the module as a consequence of the controlled or controllable egress of vapor from the orifice plate provided in proximity to the capillary member at surfaces other than the liquid feed surface. Egress of pressurized vapor jet(s) from the enclosed space formed by the substantially vapor sealing member takes place at one or more vapor permeable passage(s), such as orifice 22 of orifice plate 26.

According to an embodiment for use in liquid fuel combustion applications, the sealing member 24 is provided as shroud, constructed from a rigid material having a generally low thermal conductivity, and plate 26, constructed from a rigid material having a generally high thermal conductivity. The generally low thermal conductivity of sealing member 24 is sufficiently low to prevent a substantial portion of thermal energy from migrating from the vaporization zone toward liquid feed surface 12 of capillary member 14. The thermal conductivity of sealing member 24 may be less than about 2 watts per meter-Kelvin ("W/m K") and more often less than about 1 W/m K. The generally high thermal conductivity of plate 26 is sufficiently high to transfer the heat required for vaporization to the vaporization zone of the capillary member. The thermal conductivity of plate 26 may be greater than about 210 W/m K, and more often greater than 320 W/m K. This arrangement promotes heat transfer to and within capillary member 14 in proximity to vapor release surface 18 and vaporization zone 16, yet it advantageously minimizes heat transfer through capillary member 14 between vaporization zone 16 and liquid feed surface 12, and into the liquid feed system and any liquid reservoir.

The sealing member, in association with the orifice plate, allows for at least partial, and more usually substantial, enclosure of the vaporization module, and in particular, the capillary member. Such confinement facilitates pressurization of vapor generated within and/or on the surface of the capillary member. Pressurization of produced vapor within the enclosed space formed by the substantially vapor sealing member and subsequent release through one or more orifices is generally sufficient to form one or more vapor jet(s) having a pressure greater than the pressure at which the liquid was supplied, and may be sufficient to form one or more vapor jet(s) having a velocity sufficient to entrain and mix with a gas to form a combustible mixture without requiring introduction of energy from an external source. For most combustion applications, the vaporization module produces a vapor jet having a pressure greater than atmospheric using liquid fuel supplied at atmospheric pressure. The vaporization module of the present invention may alternatively use liquid supplied at a pressure greater than atmospheric to produce a vapor jet at a higher differential pressure.

Substantial constraint of the capillary member inhibits egress of produced vapor to a location remote from the vaporization module is limited or controllable to produce one or more vapor jets at a pressure greater than atmospheric. Substantial constraint is generally provided by a substantially vapor sealing member mounted in proximity to surfaces of the capillary member other than the liquid feed surface. A substantially vapor sealing member that provides constrainable egress of vapor may incorporate an adjustment feature such as a throttle or valve, or a variable size or number of orifices, or the like, to provide controllable vapor release from the vaporization module, while providing constraint sufficient to pressurize vapor enclosed by the substantially vapor sealing member. According to some embodiments, egress of pressurized vapor is physically limited by a sealing member and/or orifice plate having locations permitting egress of pressurized vapor, the vapor permeable locations constituting less than about 5%, more usually less than about 2%, and most often less than about 0.5% of the surface area of the sealing member and/or orifice plate.

The vaporization module of the present invention may be scaled to provide a range of pressurized vapor outputs. Adjustment of the vaporized, pressurized vapor output may be accomplished, for example, by adjusting the amount of heat supplied to the modulation module, by adjusting the flow of liquid to the liquid feed surface of the capillary member, or by limiting or adjusting the egress of vapor from the capillary member. The flow of liquid to the capillary member may be regulated by restricting capillary flow or, where an assembly of multiple individual vaporization modules is used, by removing a selected number of them from the liquid. The flow of pressurized vapor from the vaporization module may be regulated by providing a valve or a throttle, or other mechanical means. The quantity of heat supplied to the capillary member may be varied, for example, by adjusting the power provided an electrical resistive heating element or by modulating the amount of heat returned to the vaporization module from combustion.

Other ways of modulation, such as controlling the location of the vaporization zone within capillary member 14, the degree of vapor pressurization, and the amount of pressurized vapor released from the vaporization module may be assisted, for example, by varying the pore size of the capillary member, by providing capillary members having different thermal conductivity properties, by changing the configuration or arrangement of capillary member 14, by varying the number, size and/or location of vapor permeable apertures in orifice plate 26, by modulating the amount of vapor released, by adjusting the amount of heat provided to the vaporization zone, etc. These parameters may likewise be adjusted and modified to provide adaptations that permit vaporization modules to efficiently vaporize many different liquids.

The vaporization module of the present invention may be used in connection with or used to retrofit any type of apparatus that requires the formation of a pressurized vapor jet from a liquid. The vaporization module of the present invention has numerous applications including, for example, filtration, electrode and catalyst support systems, vaporization applications, and combustion devices.

The module is especially suited for combustion applications because the high porosity elements, in combination with the orifice plate and sealing member constrain the vapor generated and release gas under pressure with sufficient velocity to entrain and mix with air and make a clean burning blue flame. For example, the vaporization module may be used as a generic element in a variety of small liquid fuel burner systems to simplify and improve performance, such as portable heaters, stoves and lamps for indoor, outdoor and/or marine application Such applications including outdoor, camping and marine stoves, portable or installed heaters, lamps for indoor or outdoor use, including mantle lamps, torches, "canned heat" for keeping food or other items warm, "canned light" as a replacement or supplement to candles or other light sources, and emergency heat and light "sticks".

In some combustion applications, combustion may be achieved, for example, within 15 seconds of heating the burner head using a match or lighter, with the full capacity output of 100 watts being achieved in less than one minute. In a further example, for a miniature combustion device, the size may be ⅞ inch in diameter and 3¼ inch in height and have an empty weight of 0.9 ounces.

In another example of a combustion device an output of about 1000 Watts may be achieved. Fuel may be transported by wicking action alone. The fuel supply may be non-pressurized, with pressurization confined to the vaporization module, not the fuel reservoir.

Some embodiments may also provide for leak-proof transport without requiring the fuel storage reservoir to be emptied. In some storage condition, the structural elements of the device enclose the device and hold the cover to the base of the device, whereas while in the operating condition, the structural elements may be extended, e.g. rotated, to provide a stable support for the device and to form a stable platform for holding a cooking vessel, or the like. One such embodiment may be less than 3½ inches in height, less than 3 inches in diameter, and weigh 5 ounces when empty.

Alternative embodiments of vaporization modules, burner systems, liquid feed systems and combustion apparatus and accessory components are described more fully in U.S. Pat. Nos. 5,692,095, 5,870,525, and 6,162,046 which are incorporated herein in their entireties. It will be understood that the materials and assemblies described herein may be combined with the materials and assemblies described in the patents and patent application incorporated by reference, as desired, for particular applications.

In addition, other applications for the vaporization module include power sources for use in a variety of devices, including absorption refrigerators and other appliances, and thermal to electric conversion systems, such as thermophotovoltaic systems, thermoelectric thermopiles, alkali metal thermal to electric conversion (AMTEC) systems and fuel cells.

Combustion apparatus may also incorporate a plurality of individual vaporization modules and/or an array of burners, each burner associated with one or more modules, in applications requiring a higher heat or light output than a single pump or burner can provide. In addition, modules and/or burners having different capacities may be arrayed together for use separately or in combination.

In some embodiments, a combustion apparatus employing the vaporization module remains cool to the touch during operation other than at the burner component, the heat source, and the thermal path there between. Furthermore, the liquid fuel need not be pressurized to provide a substantially continuous vaporized fuel jet during operation. The combustion apparatus of the present invention thus incorporates many safety features not available in other types of combustion apparatus. Moreover, combustion apparatus having a vaporization module may be miniaturized and constructed from lightweight materials. Simple embodiments of the combustion apparatus employing a vaporization module, with or without a separate liquid feed system, may be designed to have few components, and no moving components. Such apparatus may be produced at a low cost and demonstrate improved reliability. The apparatus may burn efficiently and "clean," and may not be prone to clogging as a result of oxidation or pyrolosis of the liquid fuel.

Certain embodiments of combustion apparatus of the present invention do not require priming or a discrete starter mechanism to initiate liquid fuel vaporization, pressurization and combustion. In one combustion apparatus, heat applied briefly to an associated burner assembly by a match or lighter is conducted to the capillary member and is sufficient to initiate liquid fuel vaporization on or within the capillary member, leading to pressurization of the fuel vapor in the vaporization module and combustion of the resulting combustible mixture. Once combustion is initiated, the heat for fuel vaporization and pressurization may be derived by returning a portion of the heat generated by combustion to the capillary member, for example, through conductive elements forming a part of the burner in thermal communication with a thermal conductive member in proximity to the capillary member. A thermally conductive member may, for example, be located in proximity to and in thermal communication with both the capillary member and the burner to transfer the heat energy necessary for fuel vaporization and pressurization from the burner to the capillary member. According one embodiment, a steady state condition can be achieved and maintained wherein liquid fuel provided to the liquid feed surface of the vaporization module at substantially ambient pressures and temperatures is heated and pressurized within the capillary member using a portion of the heat generated in the burner to produce one or more pressurized vapor jet(s), which in turn are used for combustion. However, various ignition systems, including catalytic ignition systems, may alternatively be adapted for use in combustion apparatus of the present invention.

Figure 4:
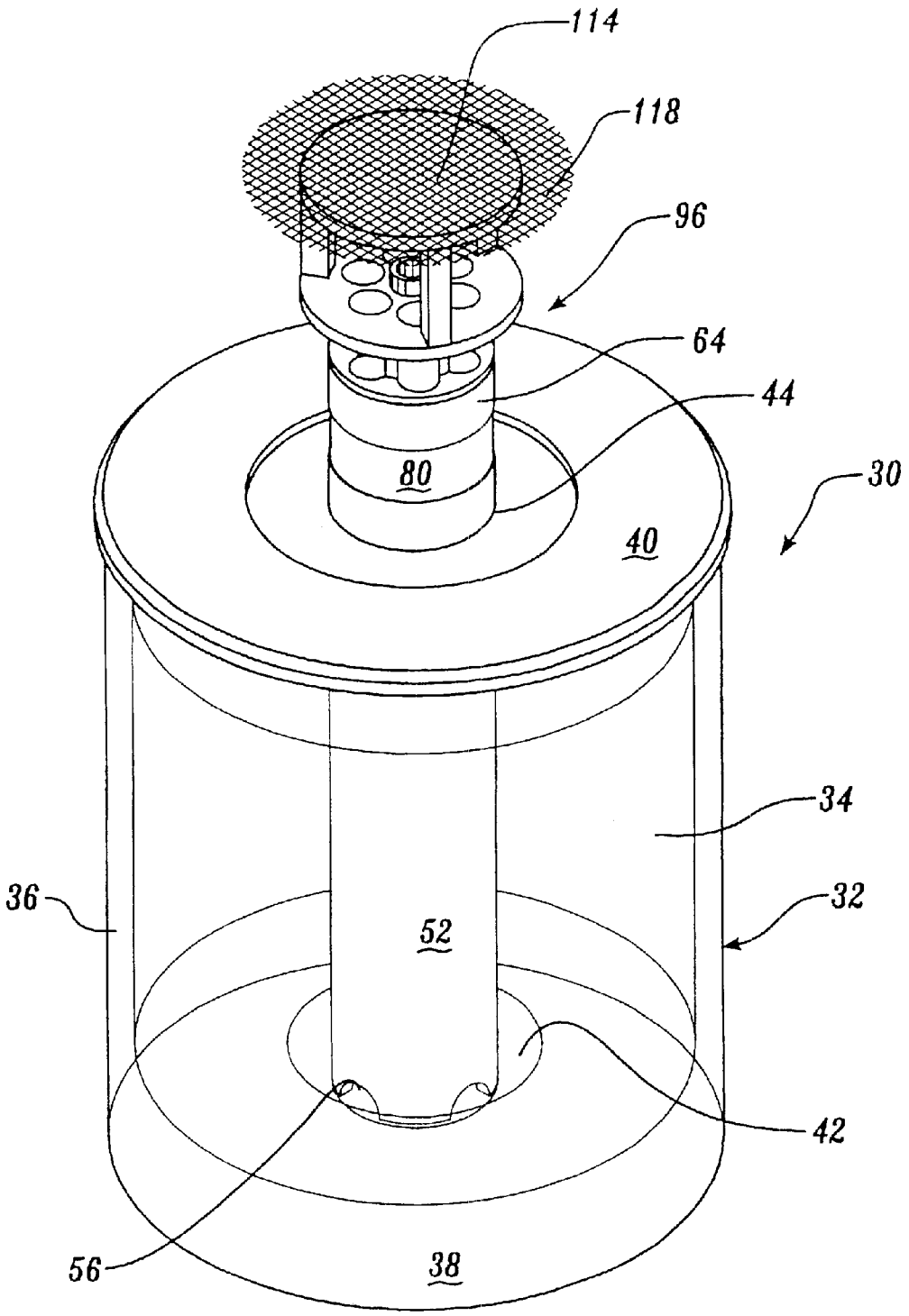
FIG. 4 shows a perspective view of a combustion apparatus utilizing a vaporization module and liquid feed system of the present invention.
Figure 5:
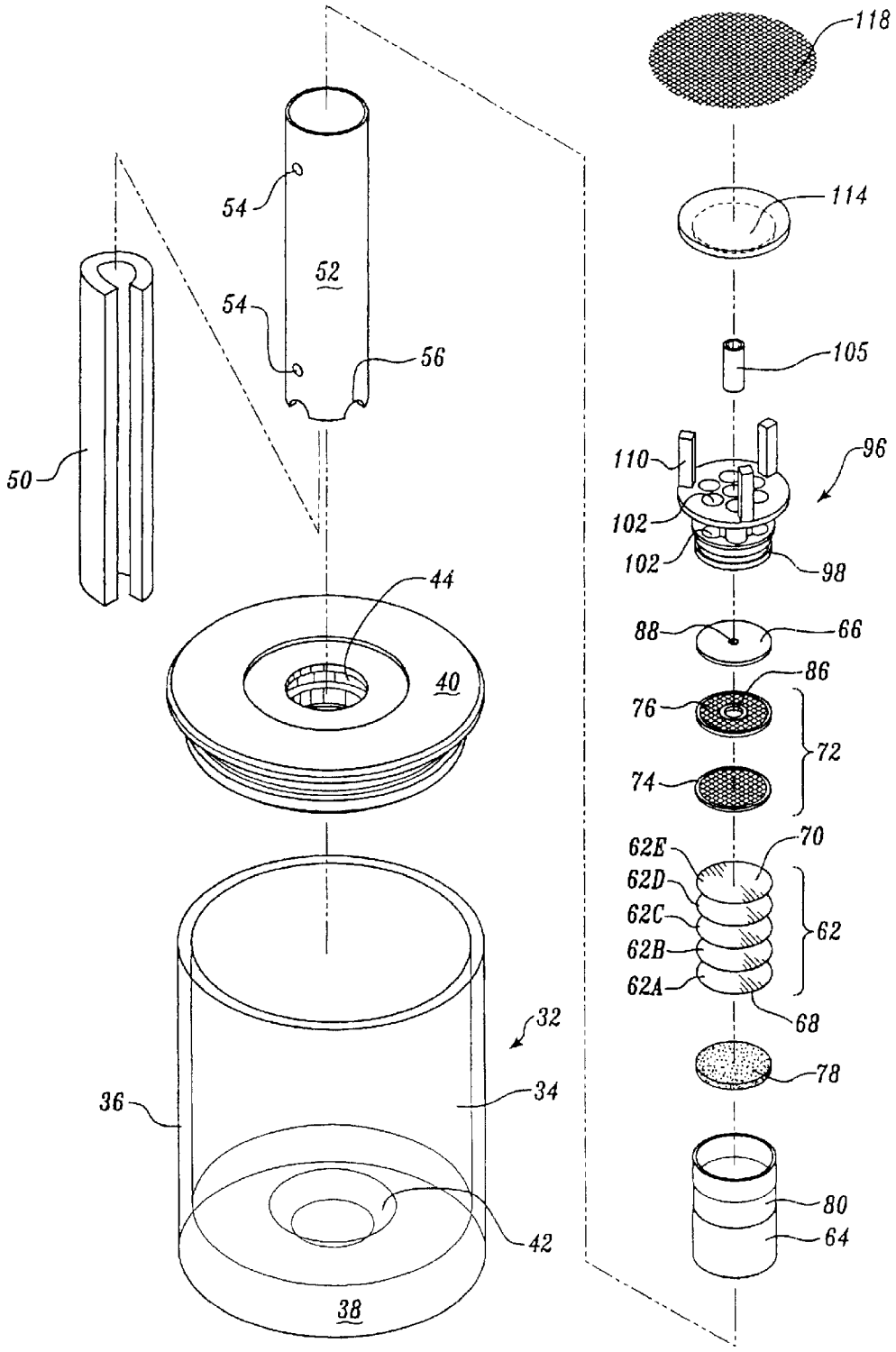
FIG. 5 shows a perspective, exploded view of the components of the combustion apparatus illustrated in FIG. 4.
Figure 6:
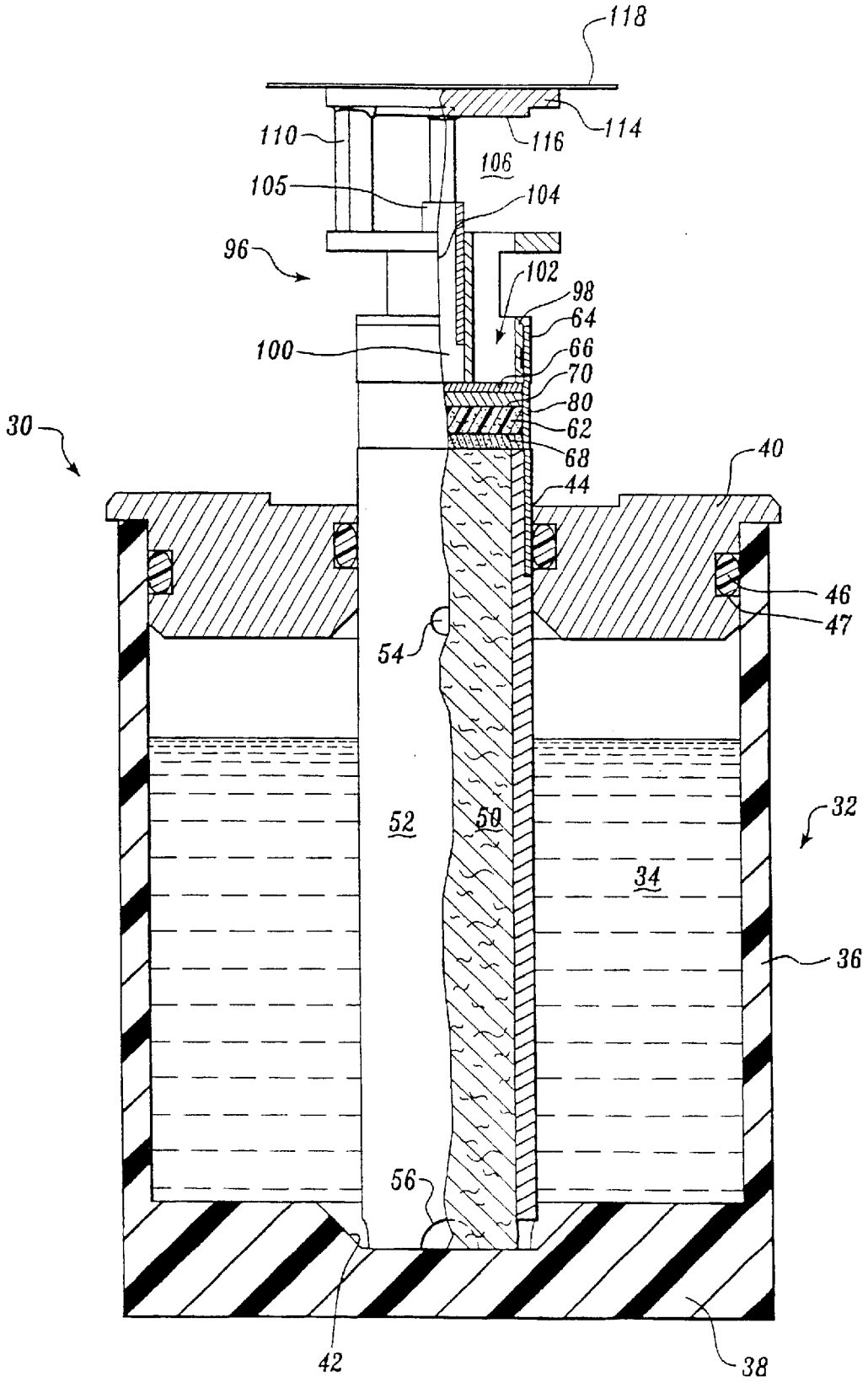
FIG. 6 shows a cross-sectional view of a combustion apparatus utilizing a vaporization module and liquid feed system similar to the apparatus shown in FIG. 4.

Various views of one embodiment of the vaporization module of the present invention in a combustion apparatus are shown in FIGS. 4–6. The embodiment depicted and described herein is illustrative, and the vaporization module of the present invention may be adapted for use with and employed in numerous other types of combustion devices and devices that vaporize liquids.

As depicted in FIG. 4, the combustion apparatus 30 incorporates a liquid fuel container 32 providing an enclosed ambient pressure fuel reservoir 34. Liquid fuel container 32 may be provided in a variety of configurations, and may be in proximity to or remote from the other combustion apparatus components. Various types of refillable containers may be used. The combustion apparatus may be designed to prevent or minimize spillage of liquid fuels from the fuel reservoir, especially where the combustion apparatus is intended to be portable, such as portable heating and lighting applications.

The liquid fuel container 32 may comprise a continuous, cylindrical sidewall 36, an end wall 38 and an opposite end wall 40. End wall 38 may incorporate a depression 42 to facilitate the flow of liquid fuel to the fuel delivery system. End wall 40 may also be provided with an aperture 44 for receiving a liquid fuel feed system or another component of the associated combustion apparatus. Sidewall 36 and bottom wall 38 may be constructed from a rigid, durable material that is impermeable to liquids and gases, and that does not react with the liquid fuel. In one embodiment, sidewall 36 may be constructed from a material that is transparent or translucent, so that the liquid fuel level is visible to the user. Some types of suitable materials include thermoplastic materials, such as polymeric plastic materials, acrylic, polypropylene, and the like. In addition, liquid fuel container 32 may be vented to the atmosphere, e.g. include vent(s), to ensure that the pressure within container 32 is equalized with ambient pressure during operation of the combustion device.

Oftentimes, the fuel reservoir is conveniently and desirably in proximity to the vaporization module. However, the fuel reservoir may also be provided remote from the vaporization module and combustion apparatus, with a fuel feed line or liquid fuel feed system feeding liquid fuel to the vaporization module. In either event, means for refilling the fuel reservoir with liquid fuel may be generally provided. For example, a sealable hole may be provided in opposite end wall 40 of liquid fuel container 32. In another example shown in FIG. 5, opposite end wall 40 of the liquid fuel container may be threadedly engageable with the fuel reservoir and removable from the rest of the container for refilling fuel reservoir 34 with liquid fuel. Alternatively, opposite end wall 40 may be detachable from and sealable against sidewall 36 by means of O-ring 46 retained in groove 47, as illustrated in FIG. 6.

In a one embodiment, liquid fuel is delivered to the vaporization module from liquid fuel reservoir 34 by means of a liquid fuel feed system. The liquid fuel feed system is capable of delivering liquid fuel substantially continuously during operation of the combustion apparatus and at a volume sufficient to sustain the desired level of combustion. Many types of liquid fuel feed systems are known in the art and would be suitable for use in combustion apparatus of the present invention. The liquid fuel feed system may be integral with the vaporization module or the capillary member, or may be provided as a separate component. A capillary-type feed system may comprise one or a plurality of capillary tubes, or a porous material, for example, that is immersed in or substantially fills the fuel reservoir.

One example of a fuel feed system, as shown in FIG. 5, comprises a feed wick 50, which may be porous, having a low thermal conductivity which may be retained in a feed wick shroud 52. Feed wick 50 absorbs and conveys liquid fuel by capillary action. Numerous absorbent, porous materials, including cotton, fiberglass, and the like, are known in the art and would be suitable. A porous material marketed by E. I. duPont de Nemours & Co., of Wilmington, Del., as "NOMEX" is an applicable material. In one embodiment, the feed wick shroud and capillary member shroud may be comprised as a unitary tubular member constructed from material, e.g. stainless steel. Feed wick 50 has a pore size and porosity to provide a liquid supply to the capillary member sufficient to produce the desired vapor output. For example, the feed wick may comprise a material having a relatively large average pore size, generally up to at least 10 times greater than the average pore size of the capillary member in the vaporization module.

Many absorbent porous materials that would be suitable for use as a feed wick stretch to a greater degree in one direction than in others. The low stretch direction of such materials may be aligned with the longitudinal axis of the feed wick. The dimensions and placement of feed wick 50 are such that fuel is absorbed and conveyed to the vaporization module regardless of the level of liquid fuel in fuel reservoir 34.

In one embodiment, the feed wick shroud 52 may be constructed from a rigid, gas and liquid impermeable material that is non-corrosive in liquid fuels and has a generally low thermal conductivity. Aluminum, stainless steel, titanium alloys, ceramic materials and thermoplastic materials may be used. At least one vent 54, as shown in FIG. 5, may also be provided in proximity to the interface of the feed wick with the vaporization module. The vent(s) prevent trapped air and gas pockets from interfering with fuel flow in the feed wicks.

The wick shroud 52 may be received through aperture 44 in end wall 40 of fuel container 32. The end of feed wick shroud 52 may be positioned in proximity to depression 42. Cutouts 56 may be provided in feed wick shroud 52 to facilitate fuel flow to porous feed wick 50. The other end of porous feed wick 50 may be in fluid communication with the vaporization module.

The vaporization module may comprise capillary member 62, sealing member shroud 64, and orifice plate 66. Capillary member 62 may comprise a plurality of capillary member layers 62A–62E as illustrated in FIG. 5, or a single porous layer 62, as illustrated in FIG. 6. Where a plurality of layers is employed, each of the layer interface surfaces may closely contact(s) the adjacent layer interface surface substantially without gaps or voids. The number and thickness of individual capillary member layers may vary, provided that the desired overall capillary member thickness and a substantially uniform average pore size are provided.

The capillary member may comprise any porous materials having a low thermal conductivity and generally uniform average pore size, such as porous ceramic or porous metallic materials, as well as composites and woven and non-woven fiber materials, would be suitable. For example, glass fiber filter material without binders distributed by Millipore as APFC 090 50 having a pore size of 1.2$\mu$ may be used. The desired configuration, e.g. thickness, of capillary member 62 depends upon the desired output capacity of the combustion apparatus, the type of liquid fuel utilized, and the like. For example, the capillary member may be composed of 15 discs of Millipore APFC 090 50 glass fiber filter material having a pore size of about 1.2$\mu$, each disc having a diameter of 0.375 inch to fill a thin-walled shroud section having a length of 0.112 inch. The discs may be slightly compressed as they were positioned in contact with the capillary member retainer and in contact with the inner shroud wall.

In embodiments in which capillary member 62 comprises a non-rigid material or a material that is prone to stretching or otherwise changing its conformation, a rigid, a liquid permeable capillary member retainer 78 may be used to provide mechanical support for capillary member 62. Where capillary member retainer 78 is employed, efficient fluid communication between the liquid feed system and liquid feed surface 68 of capillary member 62 may be maintained. Thus, capillary member retainer 78 may contact the liquid feed surface 68 of capillary member 62 closely and substantially without gaps and voids. Capillary member retainer 78 may comprise a porous, liquid permeable rigid material having a low thermal conductivity. Sintered bronze is an exemplary suitable material. The retainer size depends on the capillary member size and other module members. An exemplary size for a retainer is diameter of 0.357 inch and a thickness of 0.060 inch.

Capillary member 62 has a liquid feed surface 68 and a vaporized fuel exit surface 70. Liquid feed surface 68 is in fluid communication with the liquid fuel feed system and may contact the liquid fuel feed system directly or through one or more intermediate components. A vaporization zone is established within capillary member 62 during operation. The vaporization zone is in thermal communication with a heat transfer member, such as a hot seat, and may contact the heat source directly or through one or more intermediate components.

In one embodiment, heat transfer member 72 comprises a first vapor permeable member 74 and a second vapor permeable member 76, and is positioned in proximity to vapor transfer surface 70 of capillary member 62. First vapor permeable member 74 of heat transfer member 72 is in thermal communication with capillary member 62 directly or through one or more intermediate components to deliver heat in a substantially uniform distribution over vaporized fuel exit surface 70 of capillary member 62. Second vapor permeable member 76 is in thermal communication with first member 74 and a heat return means providing heat from combustion of the vaporized fuel. Heat transfer member 72 is in thermal communication with burner assembly 96 and provides heat to capillary member 62 using a portion of the returned combustion heat. Temperature and pressure gradients may be maintained across capillary member 62 between the liquid feed surface 68 and vapor transfer surface 70 during operation of the module. One example of a heat transfer member is positioned in contact with the upper capillary member disc. The heat transfer member may be constructed from various materials, such as tellurium-copper alloy and the grooves were chemically milled.

Vapor transfer surface 70 of capillary member 62 may be in proximity to and in thermal communication with a heat transfer member or heat source providing heat energy for vaporizing the liquid fuel in or at the surface of the capillary member. The heat source may employ an external power source, such as an electrical heating element Alternatively, the heat source utilizes heat energy returned from the heat of combustion without requiring any input from or connection to an external power source.

Heat transfer member 72 may comprises one or more members constructed from a vapor permeable material having a generally high thermal conductivity. In one embodiment illustrated in FIGS. 7A, 7B and 7C, each member of heat transfer member 72 may have a three-dimensional surface for rapid and efficient heat and fuel vapor collection and transfer. Each surface of vapor permeable members 74 and 76 has a plurality of parallel grooves 82. Parallel grooves 82 formed on opposing surfaces are provided at generally right angles to one another. Grooves 82 on each surface penetrate approximately 50% of thickness of members 74 and 76, such that through holes 84 are formed where the grooves formed on opposing surfaces intersect. Through holes 84 provide the desired vapor permeability and grooves 82 provide a collection area in which vapor is pressurized. Second vapor permeable member 76, which is in proximity to orifice plate 66, may be provided with one or more aperture 86 that assist in directing vaporized fuel to orifice 88 in orifice plate 66. Heat transfer member 72 may be constructed, for example, from copper or a copper alloy, or another material having a high thermal conductivity, using a chemical milling process to form the grooves and through holes providing the desired vapor collection and permeability.

Capillary member retainer 78, capillary member 62, and heat transfer member 72 may be mounted in a fixed position within shroud 64. Capillary member 62 is retained within a sealing member shroud 64. The edges of capillary member 62 may lie closely adjacent or in contact the inner surface of shroud 64 substantially without gaps and voids. The space between the edge(s) of capillary member 62 and the inner surface of shroud 64, at any point along the interface, may be not greater than the average pore size of capillary member 62.

In the embodiments shown in FIGS. 4–6, shroud 64 has a thin-walled section 80 in which the capillary member is retained. Thin-walled section 80 is provided to reduce the thermal conductivity of shroud 64 where it interfaces with capillary member 62, thereby reducing and minimizing heat transfer via shroud 64 through capillary member 62. Thin-walled section 80 may be desirably as thin as is practical without compromising the structural integrity of shroud 64. Many materials may comprise shroud 64 that have a low thermal conductivity, such as stainless steel, titanium alloy, etc.

Orifice plate 66, together with shroud 64, forms the substantially vapor sealing member that substantially constrains egress of vapor and encloses surfaces of capillary member 62 other than liquid feed surface 68. Orifice plate 66 may be spaced a distance from the vaporized fuel exit surface 70 of capillary member 62 to provide additional space in which vapor is pressurized. Intermediate components, such as heat transfer member 72, may occupy all or some of a space or plenum formed between orifice plate 66 and capillary member 62.

Orifice plate 66 may be provided in proximity to second vapor permeable member 76 of heat transfer member 72. Orifice plate 66 has one or more vapor permeable location (s), such as orifice(s) 88, through which pressurized fuel vapor passes to produce one or more vaporized fuel jet(s). The size and placement of orifice(s) 88 in orifice plate 66 may affect the vaporization and pressurization of liquid fuel way with the vaporization module and desirably vary for different combustion applications, different types of capillary members, and different types of fuels. In one embodiment of orifice plate 66 wherein orifice 88 has a larger diameter portion that tapers to form a smaller diameter portion from which the vaporized fuel jet is released. Such tapered orifices generally assist in forming the vaporized fuel jet. Orifice plate 66 may be constructed from a rigid material having a generally high thermal conductivity, such as copper or copper alloy, e.g. a tellurium copper alloy. The size of the orifice plate depends on the configuration of the module and, for example, may be a 0.375 inch diameter plate and have a thickness of 0.020 inch and with the diameter of the orifice being about 0.009 inch.

Burner assembly 96 may be mounted in proximity to orifice plate 66 and provides one or more chamber(s) for mixing of air or another combustible gas or mixture with the vaporized fuel. Burner assemblies having various configurations may be used.

Burner assembly 96 illustrated in FIGS. 5 and 6 has a neck 98, which fits within and is retained by shroud 64. Burner assembly 96 has a mixing chamber 100 penetrated by one or more combustion gas supply channels 102. For many applications, the combustion gas may be simply ambient air. A plurality of combustion gas supply channels 102 may be arranged radially in neck 98 for directing air into mixing chamber 100. Air for mixing with the vaporized fuel may be provided at ambient temperature and pressure or, for particular applications, may be provided at an elevated temperature and/or pressure. The air/vaporized fuel mixture exits mixing chamber 100 through a central passageway 104 and enters combustion zone 106. A mixer tube 105 may be provided in connection with central passageway 104 to direct the flow of the air/vaporized fuel mixture. Burner assembly 96 may support two or more heat conductive posts 110. Orifices facilitate the flow of air into and through supply channels 102 and facilitate the flow of the air/vaporized fuel mixture to mixing chamber 100. Burner assembly 96 may be constructed from a rigid material having a generally high thermal conductivity, such as copper or a copper alloy. Burner assemblies of various configurations may be used.

Additional mixing of the air/vaporized fuel mixture takes place in combustion zone 106. Burner cap 114 may be mounted on conductive posts 110, and collision and ignition of the air/vaporized fuel mixture takes place on underside 116 of burner cap 114. Burner cap 114, in combination with flame spreader 118, spreads and distributes the flame. Burner cap 114 may be constructed from a rigid, substantially non-porous material such as stainless steel, and flame spreader 118 may comprise a stainless steel wire screen. The burner cap may vary, e.g. diameter of 0.500 inch. The flame spreader may, for example, have an overall diameter of 0.750 inch a wire diameter of 0.009 inch, and a pitch of 0.024 inch.

In one embodiment of combustion apparatus 30, feed wick 50, capillary member retainer 78, capillary member 62, heat transfer member 72, orifice plate 66, and burner assembly 96 all have a generally cylindrical or circular configuration and are arranged in a vertically stacked arrangement, aligned on a common central axis. One combustion apparatus return a portion of the heat generated by combustion to the capillary member to sustain vaporization of the liquid fuel and production of one or more vaporized fuel jet(s) to provide continuous, steady state operation of the combustion apparatus. According to this embodiment, heat from combustion is conducted to capillary member 62 from flames or heat generated on burner cap 114 through heat conductive posts 110, through burner neck 98 to orifice plate 66 and heat transfer member 72. All of these components are constructed from materials having a high thermal conductivity. In this fashion, following initial vaporization and ignition of the combustible mixture, the combustion apparatus operates in a continuous, steady state mode without requiring introduction of heat or energy from any source external to the apparatus. A heat pipe, a capillary pump loop, and numerous other means for returning a portion of the heat generated by combustion to the vaporization module are known in the art and would be suitable for use in connection with combustion apparatus of the present invention.

Combustion apparatus may additionally incorporate an adjustable combustion output feature. The combustion output is generally modulated by increasing or decreasing the flow of vaporized and pressurized fuel into the burner assembly. Adjusting the fuel output may be accomplished in numerous ways. One system for modulating the vaporized fuel output involves modulating the heat flux in the combustion apparatus, and more particularly involves modulating the amount of heat energy returned to the vaporization module. Modulating the amount of heat returned may be accomplished, for example, by increasing or decreasing the number or capacity of heat return elements, such as conductive posts; by adjusting the position of the heat return elements with respect to the flame generated; by adjusting the flame pattern and/or content relative to the heat return element(s); by adjusting the amount of heat conducted by heat return elements, for example, by employing duty cycles, diverting a portion of the heat, or cooling a portion of the heat return elements; or by other methods that are known in the art.

Figure 8:
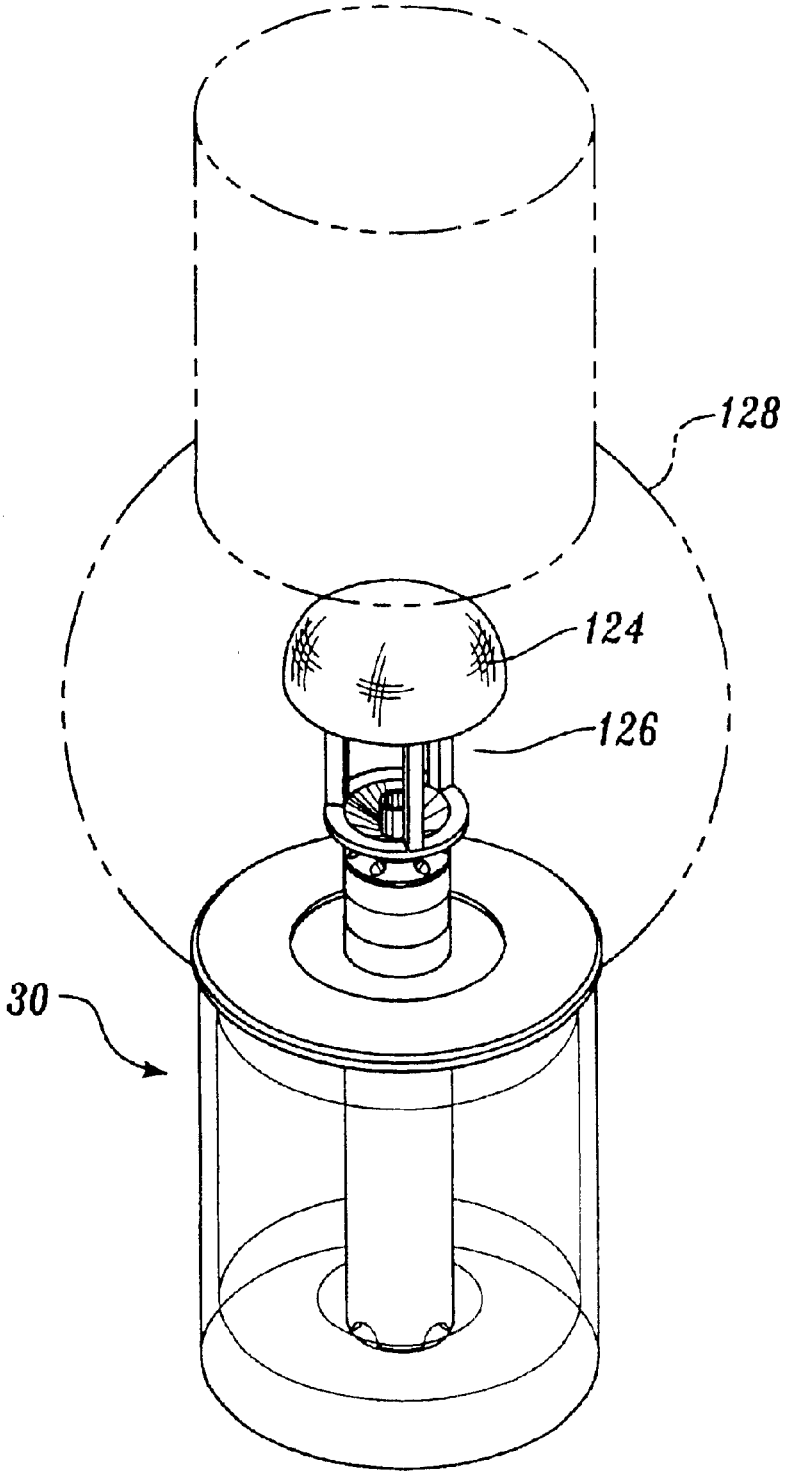
FIG. 8 shows a schematic perspective view of a combustion apparatus of the present invention in the form of a mantle lamp.

FIG. 8 schematically illustrates a combustion apparatus 30 having a vaporization module of the present invention in the form of a mantle lamp. The mantle lamp may comprise a combustion apparatus of the general type shown with respect to FIGS. 4–6, with a mantle 124 mounted on a mantle support 126 in proximity to the flame. The shape of the flame may be adjusted by modifying the configuration of the burner, for example, to provide optimal mantle illumination output. Various types of mantles, such as "bag" mantles produced and sold by Coleman Co., Inc. of Witchita, Kans., rare earth doped rigid ceramic durable mantles, and the like, may be used. Substantially rigid mantles may resist shock and handling. The combustion output, and thus the illumination output, may be varied. In addition, the mantle may be movable with respect to the burner and flame to modulate illumination output. A chimney 128, reflectors, and other accessories may also be incorporated.

Figure 9:
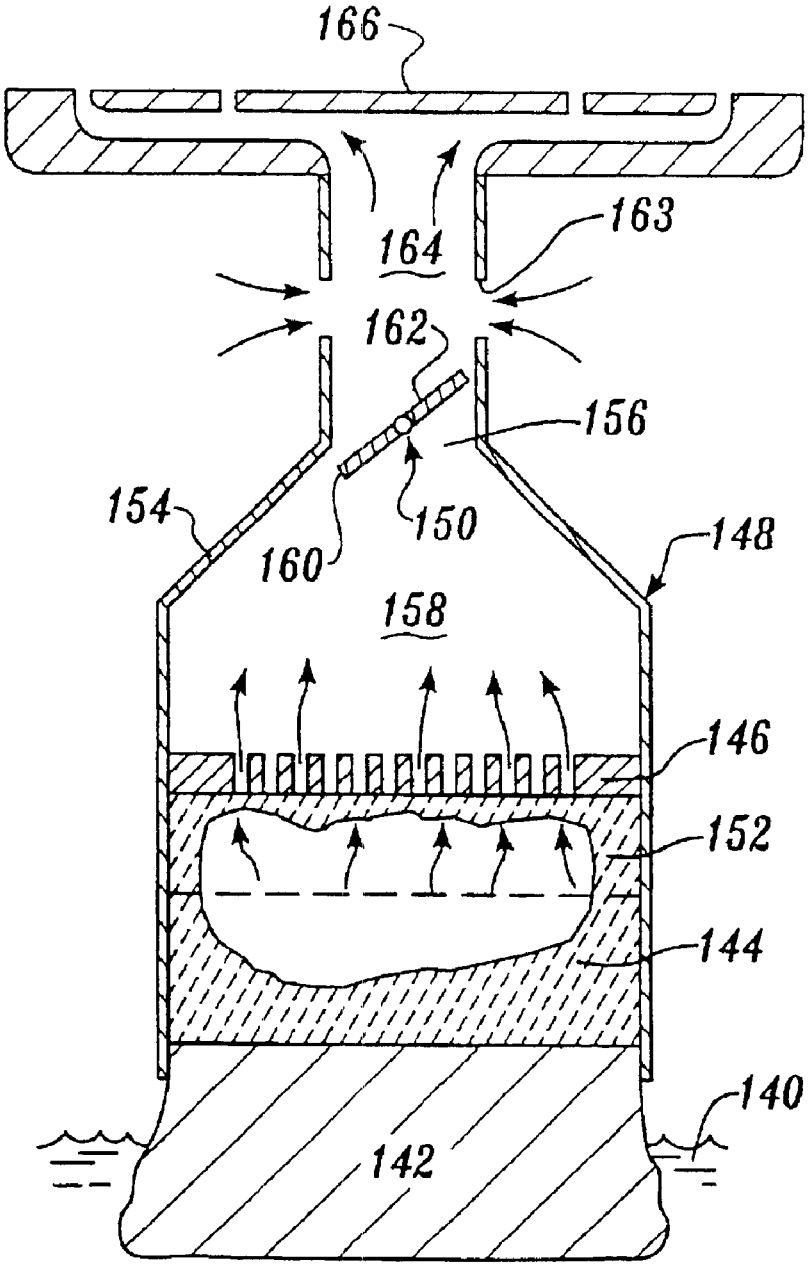
FIG. 9 shows a cross-sectional elevation view of an alternative embodiment of a combustion apparatus employing a vaporization module and liquid feed system of the present invention in which the egress of pressurized vapor from the module is variable and controllable.

Another embodiment of a combustion apparatus including a vaporization module of the present invention is illustrated in FIG. 9, wherein the flow of vapor from the vaporization module is adjustable by mechanical means. Liquid fuel 140 may be conveyed from a reservoir through a capillary feed member 142 to a lower surface of capillary member 144. Vapor permeable heat transfer member 146 may be provided in proximity to an upper surface of capillary member 144 for heating liquid fuel to its vaporization temperature. Heat transfer member 146 may be controllably heatable by an external energy source or may be heated from a portion of the returned combustion heat.

Capillary member 144 may be substantially constrainable at surfaces other than the liquid feed surface by means of substantially vapor impermeable shroud 148 and throttle 150. Shroud 148 may comprise a cylindrical portion 152 with a conical portion 154 that tapers to form a vapor release aperture 156. Shroud 148 in communication with throttle 150 may form an enclosable space 158, which may facilitate the accumulation and maintenance of vapor pressure during operation of the combustion device. Release of pressurized fuel vapor through vapor release aperture 156 may be adjustable by means of throttle 150, which may conveniently comprise a plate 160 matching the configuration of vapor release aperture 156. The plate 160 may be pivotable about pivot axis 162 to adjust the flow of vapor from enclosed space 158.

During operation of the combustion apparatus shown in FIG. 8, liquid fuel is vaporized in capillary member 144 and fuel vapor exits the capillary member, travels through heat transfer member 146, and collects in enclosed space 158. Adjustment of throttle 150 may vary the flow and velocity of vapor to mixing chamber 164 and consequently varies the pressure at which vapor is released. Vaporized fuel mixes with air introduced through apertures 163 in mixing chamber 164 to form a combustible mixture that may be ignited and burned in burner 166.

One embodiment of a liquid fuel burner apparatus may have the vaporization module of the present invention in a thermophotovoltaic system to convert thermal energy to electrical energy. Liquid fuel combustion apparatus may employ the vaporization module to produce thermal energy, which is converted to radiant electromagnetic energy by emitter(s). Some emitters may be ceramic and may be doped with rare earth oxides. Electromagnetic energy emitted from emitter(s) may be converted to electricity in suitable thermophotovoltaic cell(s). Some examples of thermophotovoltaic cells include crystalline silicon cells, gallium antimonide (GaSb) infrared-sensitive cells, cells employing germanium, certain Group III-V materials such as gallium indium arsenide, and the like.

Alternative embodiments of the vaporization module, liquid feed system and combustion apparatus and accessory components arranged to provide a stove are illustrated in FIGS. 10–22.

Figure 10:
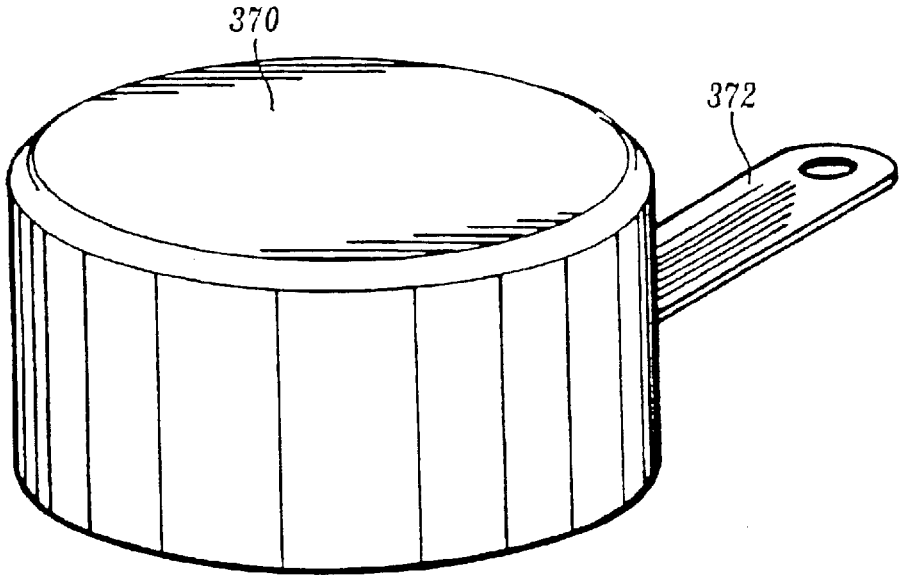
FIG. 10 shows a perspective representational view of another embodiment of a vaporization module and liquid feed system of the present invention in a camp stove.
Figure 10:
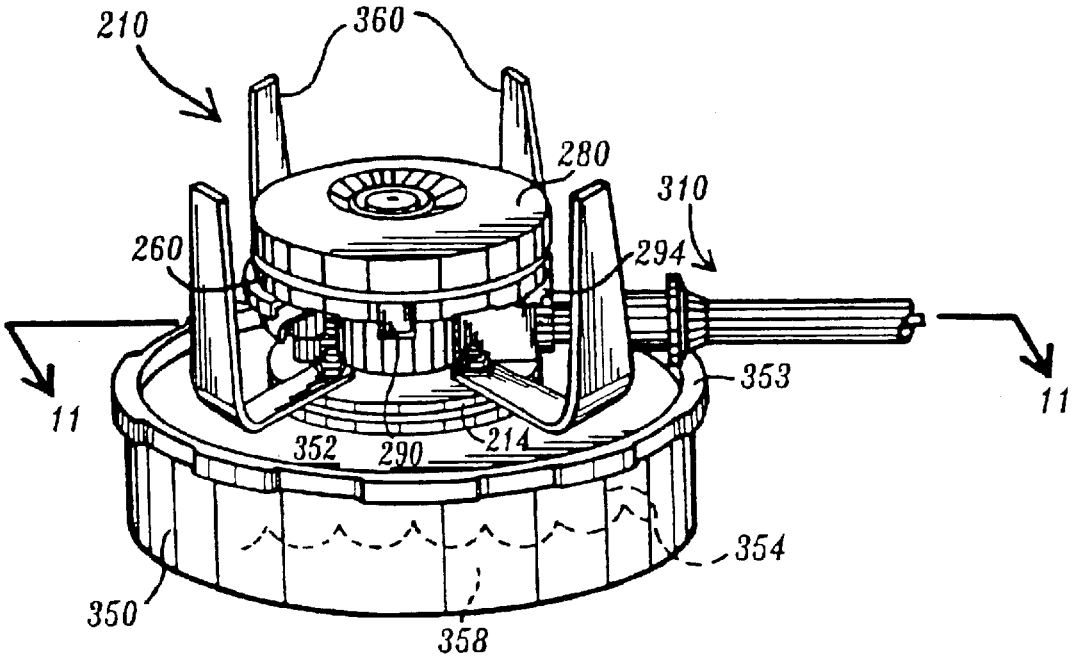
Figure 11:
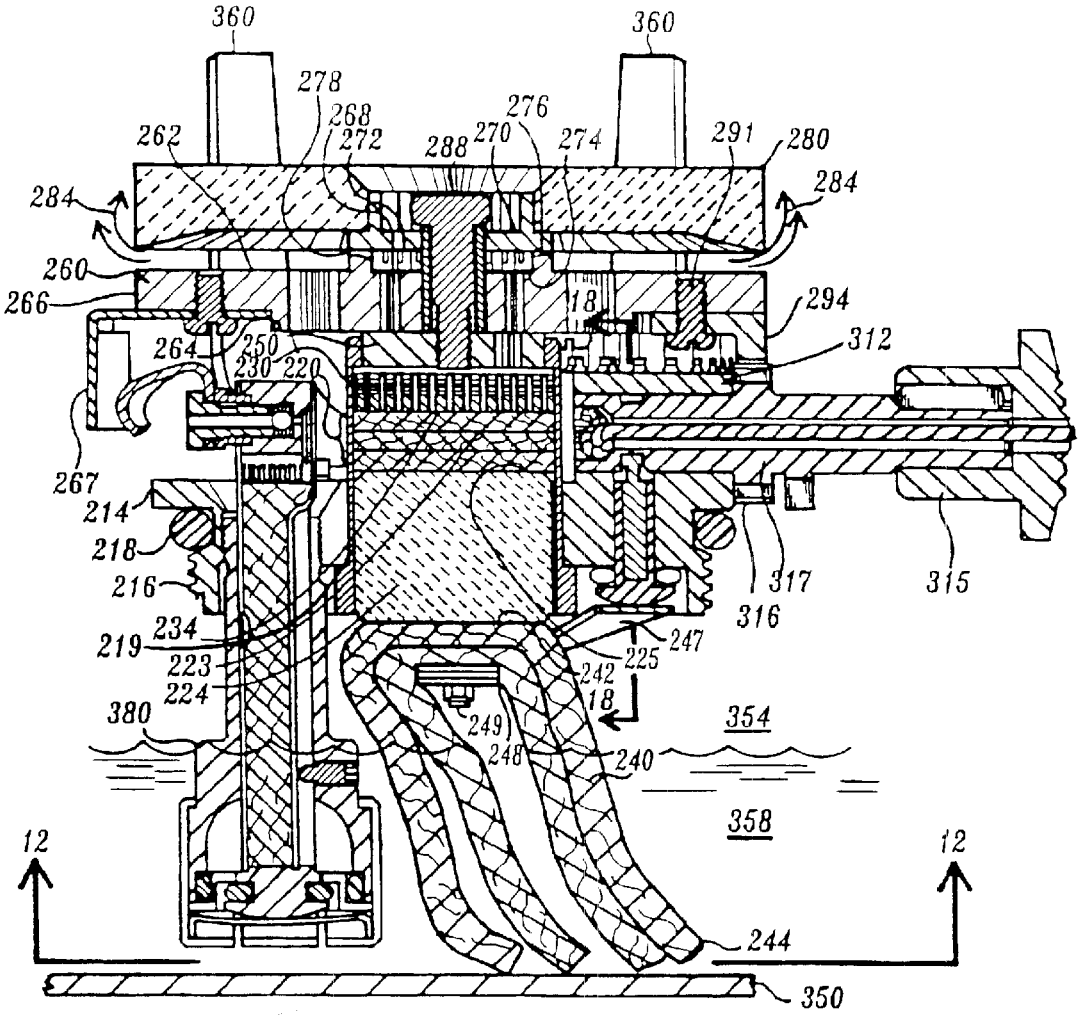
FIG. 11 is a cross sectional view along line 11—11 of FIG. 10.
Figure 12:
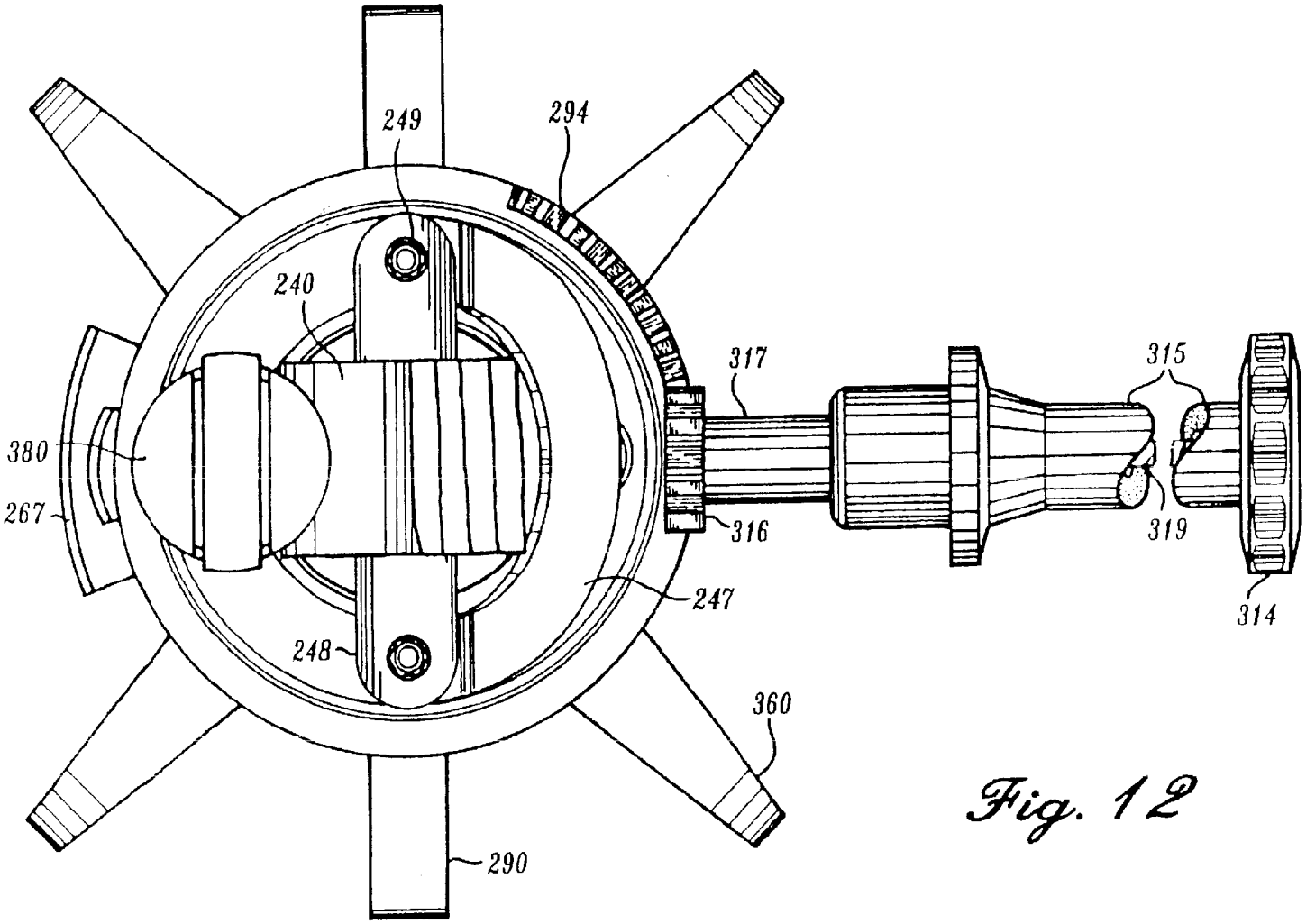
FIG. 12 is a bottom plan view along line 12—12 of FIG. 11.

In FIGS. 10 and 11, fuel reservoir 350 holds liquid fuel 358. Fuel reservoir lid 352, having lip 353 and carrying boiler frame 214 and associated apparatus, provides an airtight closure to fuel reservoir 350. Boiler frame 214 may screw into fuel reservoir lid 352 by means of threads 216, with resilient O-ring 218 providing a fluid tight seal between boiler frame 214 and fuel reservoir lid 352. In one embodiment, fuel reservoir 350, fuel reservoir lid 352, and boiler frame 214 are made of aluminum, which provides a light, sturdy structure. However, in other embodiments these parts may be formed of other materials.

Shroud 219 is an elemental cylindrical member, which passes vertically through, and is supported by, boiler frame 214. Shroud 219 is made of a thin wall of solid material, which is a poor conductor of heat. Shroud 219 houses fuel liquid feed member 224, fuel capillary member 220, heat transfer member 230, and orifice plate 250.

Referring to FIGS. 10 through 16, the top 242 of supply wick 240 may be pressed against the lower surface of liquid feed member 224 by means of clips 248 and nuts 249. The ends 244 of supply wick 240 may dangle freely submerged in liquid fuel 358. Supply wick 240 may be made of Kevlar felt in one embodiment, or other porous flexible materials or rigid porous materials, such as glass frit or ceramic may be utilized. The pores are of appropriate size to wick fuel 358 from fuel reservoir 350 from supply wick ends 244 up and out the top 242 through liquid feed member 224 under capillary action and provide liquid fuel 358 to capillary member 220 at the appropriate boiling pressures. In alternative embodiments, a portion of liquid feed member 224 may be directly submerged in liquid fuel 358, obviating the need for supply wick 240.

Figure 15:
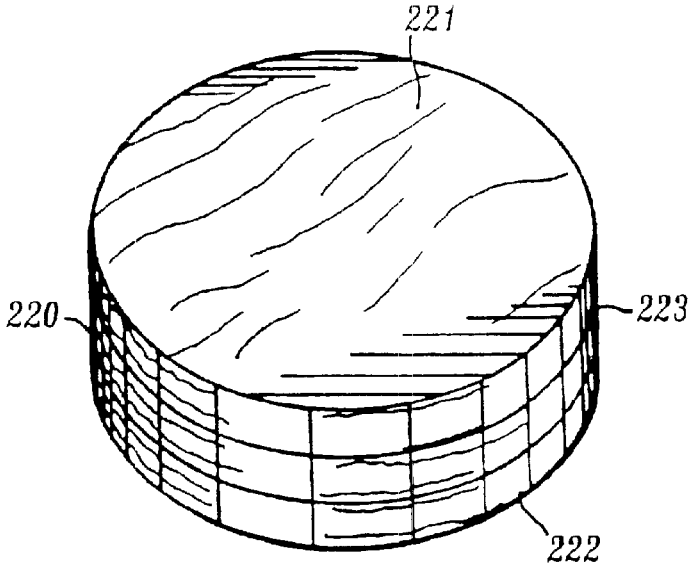
FIG. 15 is an isometric representational view of one embodiment of a capillary member of the invention.
Figure 16:
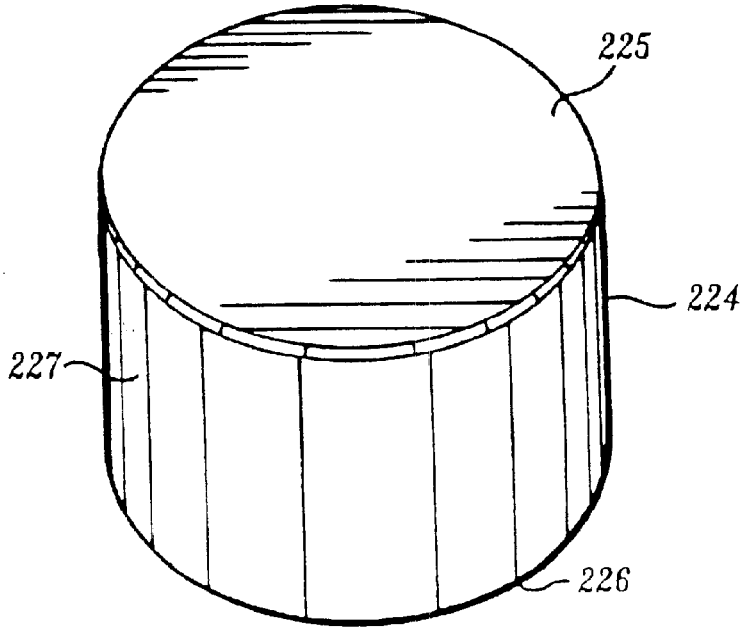
FIG. 16 is an isometric representational view of one embodiment of a liquid feed member portion of the liquid feed supply of the invention.
Figure 17:
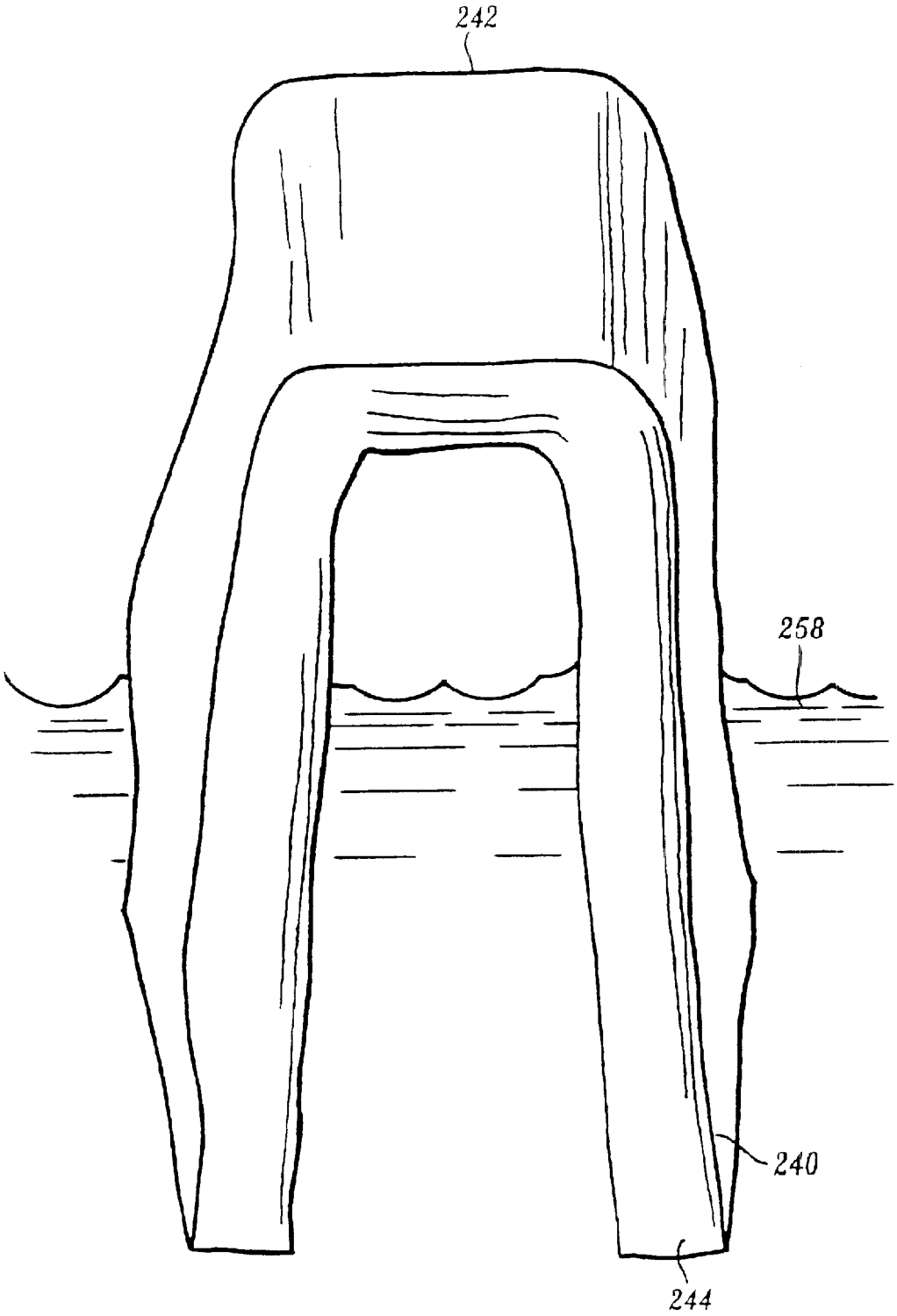
FIG. 17 is a perspective representational view of one embodiment of a supply wick portion of the liquid feed supply of the invention.

As depicted in FIGS. 15 and 16, capillary member 220 may be a disk shaped member compressed between the upper surface 225 of liquid feed member 224 and the lower surface 234 of heat transfer member 230. In one embodiment, capillary member 220 may be made of three discs of Kevlar felt. However, in other embodiments, capillary member 220 may be made of other porous materials, such as ceramic, of appropriate pore size. Also, in other embodiments, capillary member 220 may be of unitary, versus laminar, construction. Capillary member 220 may fit snugly within shroud 219 so that a seal is formed between circular edge 223 of capillary member 220 and the inner surface of sealing member shroud 219, so that fluid flow will be through the pores through wicking and not through any edge gaps exceeding the average pore size of the capillary member. Capillary member 220 is of appropriate pore size and material so that capillary action provides a supply of liquid fuel and so that heat transferred from heat transfer member 230 to the capillary member provides for a boiling transition from liquid to fuel vapor over an appropriate range of temperatures and pressures. If the capillary member 220 is made of a rigid, porous material, such as a ceramic or metal, a vapor tight seal between edge 223 and shroud 219 may be accomplished by precise manufacture, isometric seals, or by the use of caulking type adhesives. However, capillary member 220 may also comprise a pliable soft material such as plastic foam, conformable bat or felt, which can be compressed into the needed sealing contact.

Liquid feed member 224 is a generally cylindrical rigid member made of porous material with pore size compatible with that of supply wick 240 and capillary member 220. In one embodiment, liquid feed member 224 is made of ceramic, though it may also be made of metal.

Figure 13:
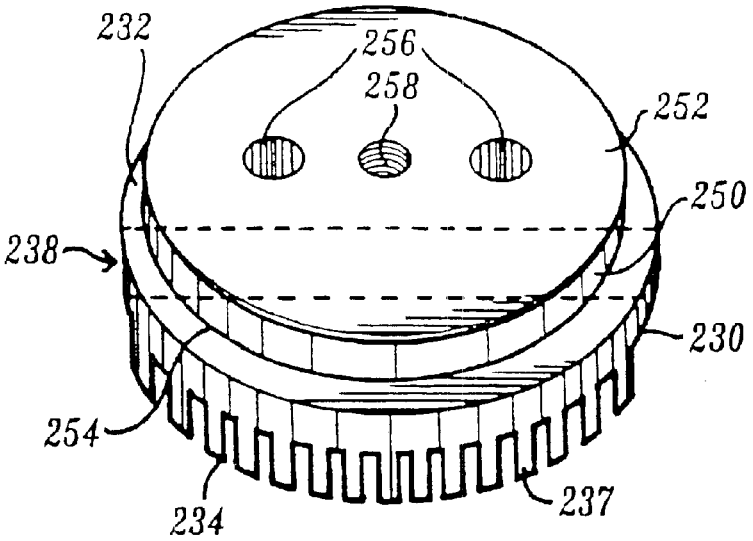
FIG. 13 is an isometric representational view of another embodiment of an orifice plate and heat transfer member of the present invention.

As shown in FIG. 13, heat transfer member 230 and orifice plate 250 may be generally cylindrical members formed or assembled as a unit, being unitary in construction. The upper surface 232 of heat transfer member 230 may form an interface with the lower surface 254 of orifice plate 250. Both may be formed of heat conductive materials, such as metals, for conducting heat from heat returns 290 through valve plate 260, and into capillary member 220 for boiling the liquid fuel. Heat transfer member 230 and orifice plate 250 may be made of different materials both are formed of the same material, e.g. aluminum.

Furthermore, orifice plate 250 may be a generally cylindrical disk having upper and lower surfaces 252 and 254, respectively. Lower surface 254 may mate with upper surface 232 of heat transfer member 230, and may be formed integrally therewith. Orifice plate 250 may be provided with orifices 256 extending through the plate from upper surface 252 to lower surface 254 which provide fluid communication and flow passages for boiled fuel vapor from heat transfer member 230 to valve plate 260. Screw hole 258 in orifice plate 250 receives screw 288, as shown in FIG. 11, for holding valve plate 160 and additional portions of the apparatus in place.

Figure 14:
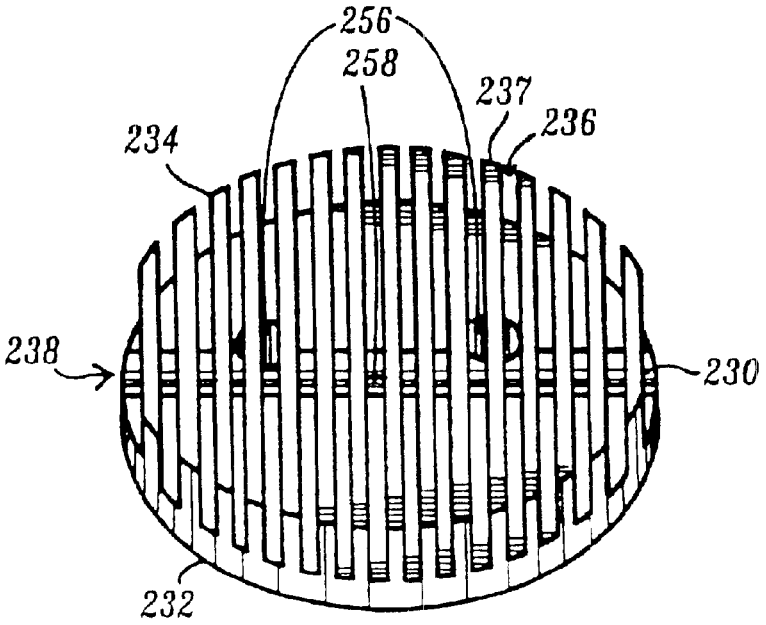
FIG. 14 is an isometric representational view showing the bottom face of one embodiment of a heat transfer member of the invention.

In the heat transfer member 230, as shown in FIG. 14, the lower surface 234 of heat transfer member 230 may be provided with a series of narrow slots or grooves cut into the lower surface and extend approximately half of the vertical, or axial, length of heat transfer member 230. The material between the notches 236 may form a series of parallel vanes 237, which contact the upper surface 221 of capillary member 220. The vanes 237 may provide a means of conducting heat from the heat transfer member to the capillary member, while the notches 236 between the vanes may provide flow passages for the vapor boiling out of capillary member 220. The upper surface 232 of heat transfer member 230 may be provided with a channel 238 extending sufficiently deep into the vertical length of the heat transfer member, so that fluid communication is provided from lower surface 234 through notches 236 and through channel 238 for boiling fuel vapors escaping from capillary member 220 and on to orifice plate 250.

Referring again to FIGS. 10 and 11, valve plate 260 may be a generally cylindrical member having upper and lower surfaces 262 and 264, respectively, and generally circular edge 266. Valve plate 260 may provide the dual functions of conducting heat from heat return tabs 290 to orifice plate 250 and thence to heat transfer member 230, and a means for throttling the flow of fuel vapor out of orifice 256 in orifice plate 250 and on to jet former 270. Heat return tabs 290 may extend from edge 266 of valve plate 260, and may be formed integrally therewith. In one embodiment, however, heat return tabs 290 may be made of copper and also may be attached to valve plate 260 by means of screws 291.

Starter guard 267 may be fixedly attached to valve plate 260 and prevent operating of the starter assembly 380 unless valve plate 260 is rotated to align the boiler system for operation, as described below. Ports 268 may extend generally vertically through valve plate 260 from lower surface 264 to upper surface 262, and when valve plate 260 is properly aligned, may provide fluid communication for fuel vapor between apertures 256 in orifice plate 250 and jet former 270.

Upper surface 262 of valve plate 260 may fixedly mate with lower surface 274 of jet former 270. Lower surface 264 of valve plate 260 may closely and rotatably contacts upper surface 252 of orifice plate 250. By rotating valve plate 260 about screw 288 through action of control shaft 310, ports 268 in valve plate 260 may be made to come into varying alignment with apertures 256 in orifice plate 250, and thereby adjustably throttling the flow of fuel vapor exiting orifice plate 250 and escaping into jet former 270. In this way, the flame strength, and consequently the heat output, of the stove, may be regulated. Valve plate 260 is made of any heat conducting material, such as aluminum.

Figure 19:
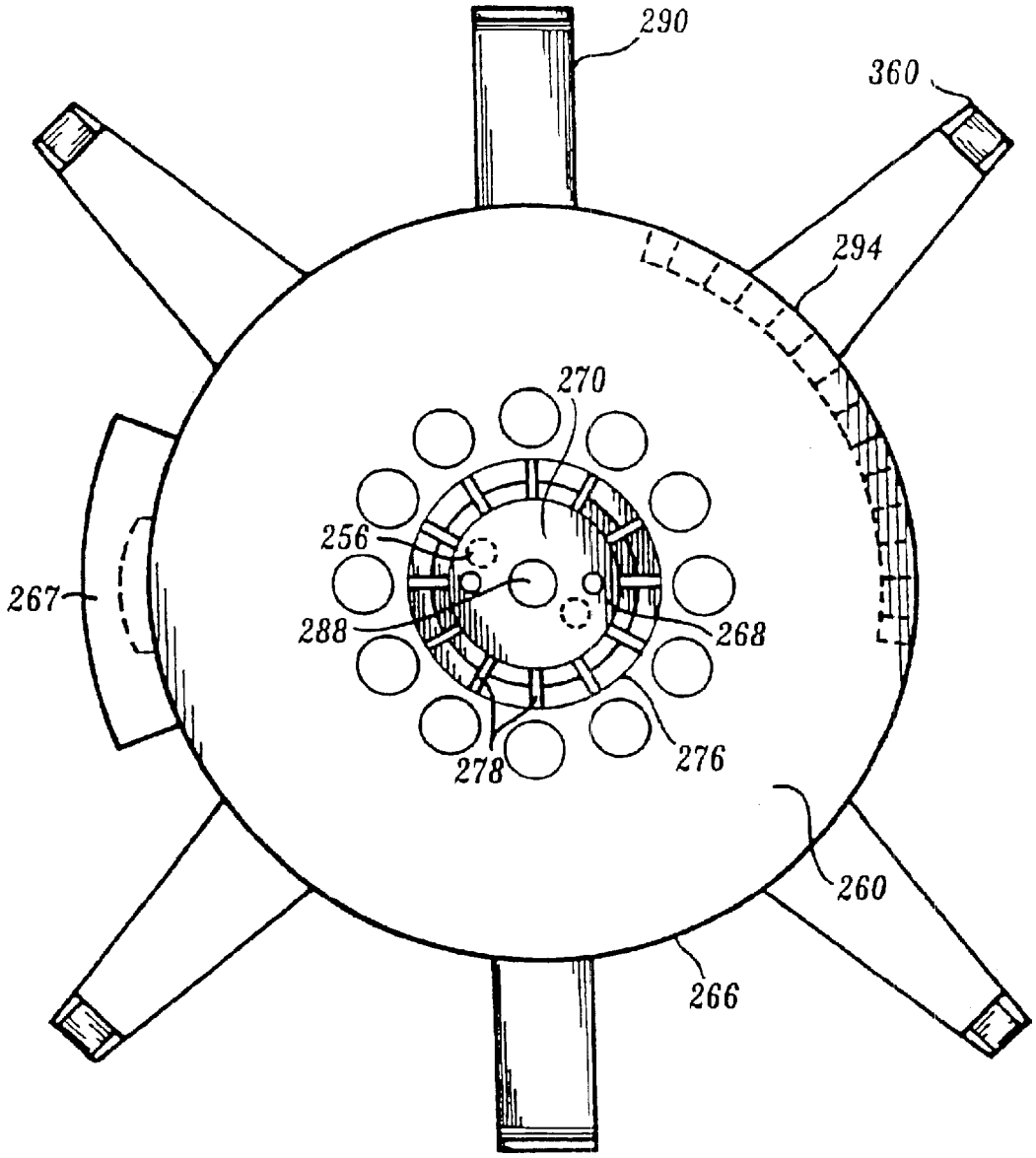
FIG. 19 is a top plan view of one embodiment of a flame plate and aperture and valve plates of the invention.

In addition, a jet former 270, as shown in FIGS. 11 and 19, may be a generally cylindrical member forming a generally cylindrical hollow chamber, and having upper and lower surfaces 272 and 274, respectively, and an outer edge 276. A series of jet orifices 278 cut through outer edge 276 provide fluid paths for fuel vapor escaping from the central chamber of jet former 270. Jet orifices 278 may be sized to form jets of escaping fuel vapor which mix with ambient air and the mixture may be then burned to form flames 284. Jet orifices 278 may be narrow elemental slots. Also, jet former 270 may be integral with the upper surface 262 of valve plate 260. Jet former 270 may rotate about screw 288 along with valve plate 260.

Flame plate 280 may be a generally circular disk, which sits atop, and is in fixed contact with upper surface 272 of jet former 270. Flame plate 280 may rotate about screw 288, along with jet former 270 and valve plate 260. Flame plate 280 may be sized in diameter to divert flames 284 horizontally outward from jet orifices 278 and form an essentially circular flame ring, suitable for cooking and heating purposes. In one embodiment, flame plate 280 is made of ceramic, but in other embodiments it may be made of any suitable flame and heatproof material.

As shown in FIG. 19, valve plate 260 may include heat return tabs 290 that may be fixedly attached to, and extend horizontally outward from, the edge 266 of the valve plate and at equal intervals. Heat return tabs 290 may transfer a portion of heat from flames 284 back to heat transfer member 230. Heat return tabs 290 may be empirically sized and shaped to transfer the appropriate amount of heat through valve plate 260 and orifice plate 250 on to heat transfer member 230. At high vapor flow, a high heat flow may be required to vaporize fuel in the boiler, while at low vapor flow, only a little heat may be required to vaporize fuel in the boiler. Heat return tabs 290 may be shaped and arranged to intercept a portion of flames 284. The size and location of flames 284 depends upon the setting of valve plate 260 relative to orifice plate 250. Therefore, the portion of flames 284 intercepted by heat return tabs 290 may vary with the amount of the vapor throttling. This action provides a heat flow into heat return tabs 290, which may be appropriate to various stove settings. Heat return tabs 290 may also be angled upward from the horizontal at their ends, such that the larger flames 284 at higher burner settings will impinge upon the upturned ends of the heat return bars. In this manner, more of the flames' heat may be transferred to heat return tabs 290 and onto heat transfer member 230 for increased boiling rate. In one embodiment, heat return tabs 290 are made integral with the valve plate 260.

Figure 20:
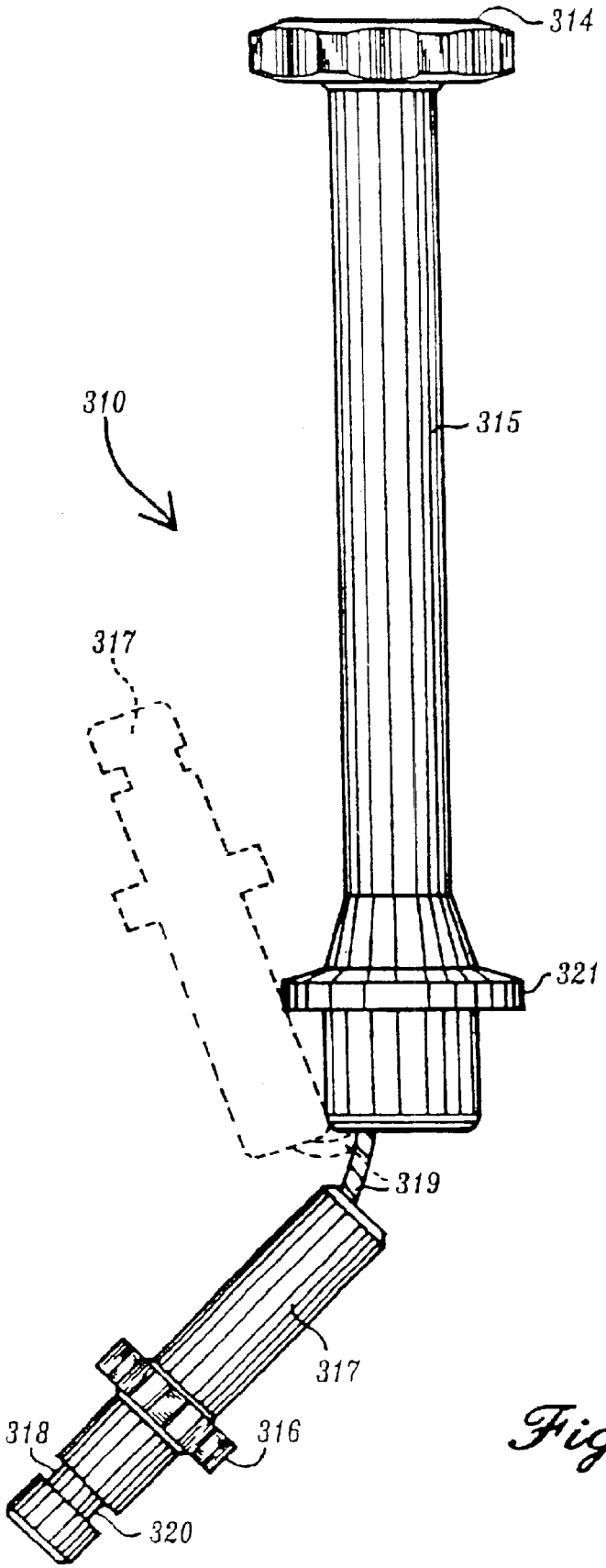
FIG. 20 is a top plan view of knob and pinion shafts showing a collapsibility feature of one embodiment of the invention.

Referring to FIGS. 11 and 20, a control shaft 310 may be positioned within, and extends from, shaft housing 312, which itself may sit atop boiler frame 214. Control shaft 310 may be comprised of two portions, knob shaft 315 and pinion shaft 317, one end of pinion shaft 317 being received within one end of knob shaft 315. Knob shaft 315 and pinion shaft 317 may be generally cylindrical and hollow members tied together by internal resilient shock cord 319. This arrangement may permit quick reassembly after collapsing the two shafts into a smaller length for ease of portability. Flange 321 of knob shaft 315 may be shaped to prevent its sliding past fuel reservoir lid lip 353 and detaching from pinion shaft 315 unless control shaft 310 is in a position to shut all valves, thereby providing a stowage interlock.

Control shaft 310 may be used to manually control the heat output of the stove by varying the angular position of valve plate 260 relative to orifice plate 250. This is achieved by means of pinion 316 on pinion shaft 317. Pinion 316 joins face gear 294, which extends down from valve plate 260. When knob 314 is rotated by hand, causing pinion 316 to rotate and face gear 294 to translate relative to pinion 316, valve plate 260 may be caused to rotate about screw 288, thus changing the throttling between orifice plate 250 and valve plate 260, and hence the vapor escaping to jet former 270 and the size of flames 284 exiting jet ports 278.

Figure 18:
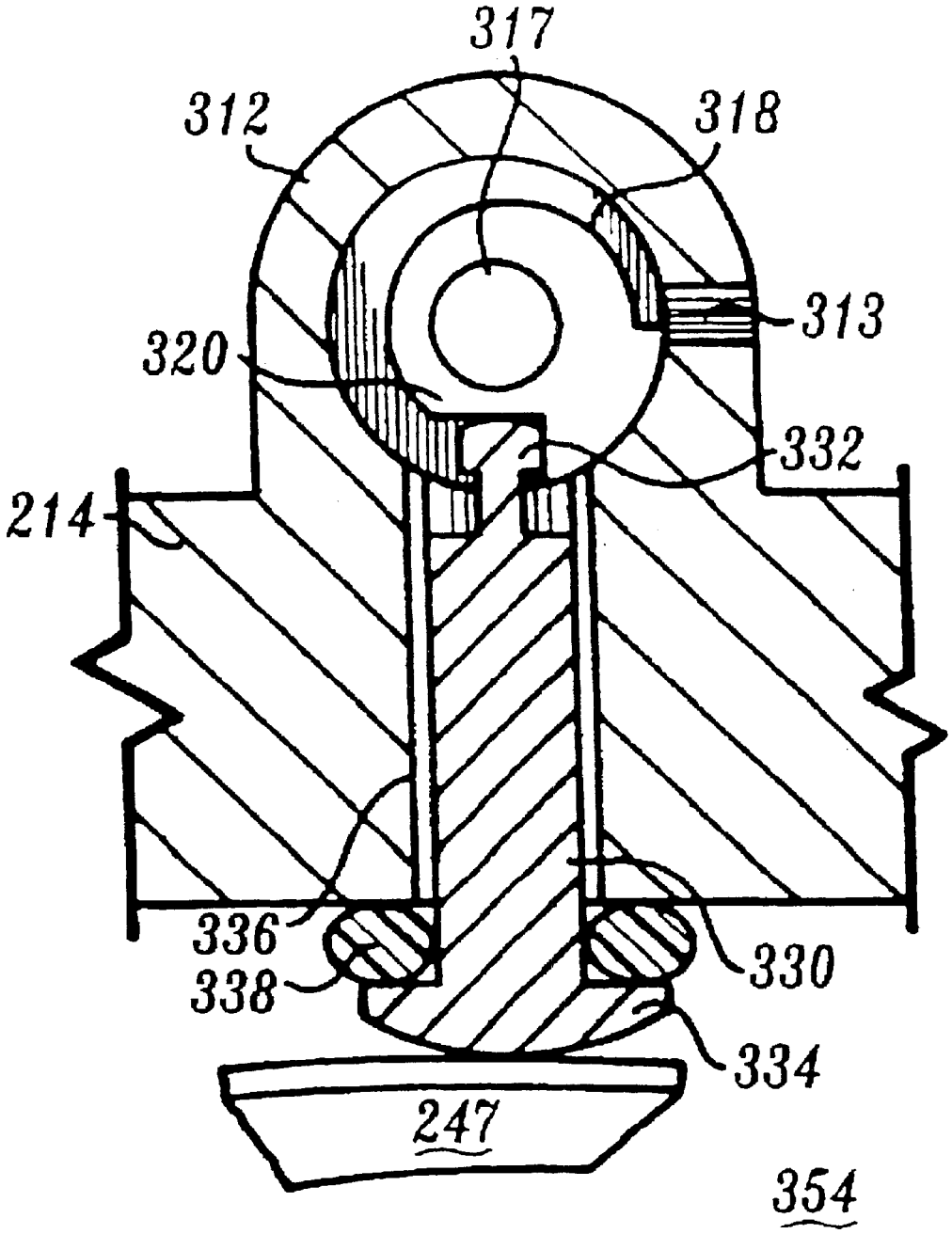
FIG. 18 is a cross-sectional view along line 18—18 of FIG. 13.

As shown in FIG. 18, a pinion shaft 317 may be provided with slot 318 and detent 320 within slot 318. Slot 318 may be an annular cut extending for 270° rotation of pinion shaft 317. Detent 320 may be a flattened, slightly deeper section at one end of slot 318. Slot 318 and detent 320 control the position of vent piston 330 to provide an air path from vent hole 313 into gas space 354 within fuel reservoir 350.

In addition, as shown in FIGS. 11 and 18, a vent piston 330, having tip 332 at its upper end and head 334 at its lower end, may be slidably received into vent hole 336 in boiler frame 214. Spring 247 may be a resilient, thin metallic semicircular member, the ends of which may be fixed by nuts 249. Spring 247 may act on head 334 of vent piston 330, both to hold vent piston 330 in place, and to provide a positive, generally upward force on the piston to force tip 332 into positive engagement with slot 318 of control shaft 310. The diameter of the central portion of vent piston 330 may provide sufficient clearance between the piston and the inner walls of vent hole 336 to permit the passage of air. Tip 332 of vent piston 330 may ride in slot 318 of control shaft 310 as control shaft 310 is rotated to control the heat output of the stove. Slot 318 may permit all angular positions of control shaft 310, except when tip 332 is seated in detent 320, vent piston 330 to be in a downward "open" position, permitting the passage of air from atmosphere through vent hole 313 into shaft housing 312, through vent hole 336 along the gap between vent piston 330 and the inner wall of vent hole 336 into gas space 354 of fuel reservoir 350. This air path may prevent the drawing of a vacuum in gas space 354 as fuel is consumed and the level of liquid fuel 358 in fuel reservoir 350 to decrease.

Slot 318 and detent 320 may be placed so that when control shaft 310 has been rotated to close off the fuel vapor escape path through apertures 256 in orifice plate 250, and thus shut down the stove, the tip 332 on vent piston 330 may be engaged in detent 320. Detent 320 may be cut deeper into pinion shaft 317 than slot 318, so that when detent 320 engages tip 332 of vent piston 330, vent piston 330 may slide higher into vent shaft 336, seating O-ring 338 at the lower end of vent shaft 336 to seal off the air flow path from atmosphere to gas space 354 and fuel reservoir 350. In this way, when the stove is shut down, fuel reservoir 350 may be sealed closed to allow for the stove to be transported in any position relative to horizontal without the danger of leaking or spilling liquid fuel.

Figure 21:
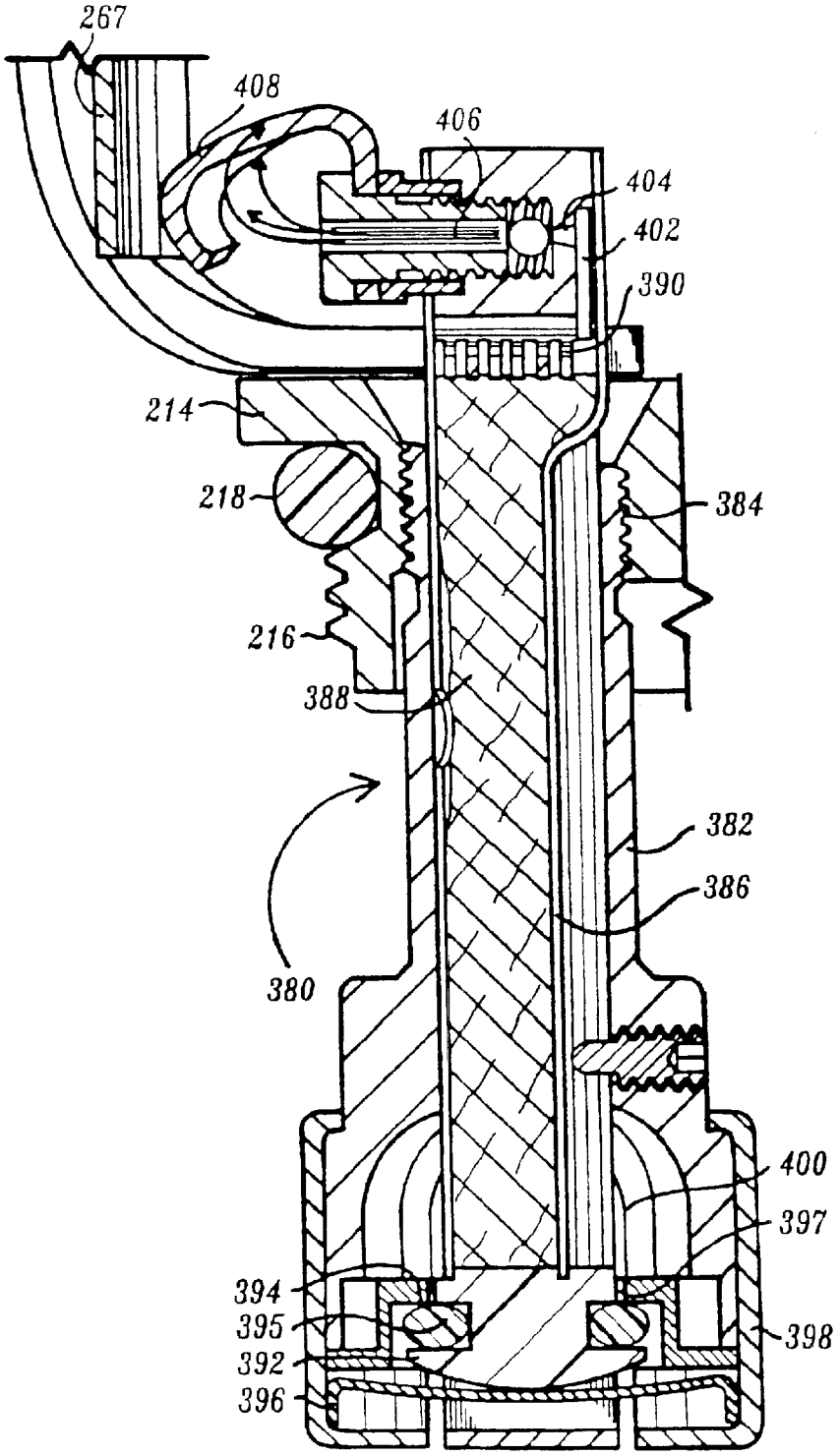
FIG. 21 is a detail view of a portion of FIG. 13 showing a starter assembly of the invention.

Furthermore, a starter assembly 380, as shown in FIGS. 11 and 21, may be provided and comprised of a generally cylindrical sheath 382 attached to boiler frame 214 by means of threads 384, and extend down into fuel reservoir 350. Generally a cylindrical wick tube 386 may be slidably disposed within, and extend a distance above sheath 382. Plunger 392 may be fixedly attached to the lower end of wick tube 386, and move vertically with wick tube 386. Spring bar 396 may apply a generally upward force on plunger 392 and wick tube 386. O-ring 394, disposed within groove 395 in plunger 392, seals shut fuel inlet 397 when plunger 392 is in its uppermost position. Fuel chamber 400 may communicate with fuel reservoir 350 when fuel inlet 397 is not blocked by O-ring 394. Starter heat transfer member 390 may be fixedly disposed within wick tube 386 near its upper end. Starter heat transfer member 390 may also be a vane, channeled disc similar to heat transfer member 230. Starter wick 388 may disposed within sheath 382 and extend from fuel chamber 400 up to the lower surface of starter beat transfer member 390. Starter wick 388 may be made of porous, flexible materials, or rigid porous materials, such as Kevlar felt, glass frit or ceramic. The pores of starter wick 388 is usually of appropriate size to wick fuel 358 from fuel chamber 400 up to starter heat transfer member 390 through capillary action and provide liquid fuel 358 to its upper end at the appropriate boiling pressures. The upper end of starter wick 388 may be pressed firmly against the lower surface of starter heat transfer member 390 and the inner surface of wick tube 386. With wick tube 386 acting as a shroud, starter heat transfer member 390 and the adjacent portion of starter wick 388 may function as a capillary feed boiler for boiling liquid fuel 358 transferred by the starter wick 388 from fuel chamber 400. Heat transferred from starter heat transfer member 390 to the upper portion of starter wick 388, may provide for a boiling transition from liquid to fuel vapor over the appropriate range of temperatures and pressures.

Boiled fuel vapor from starter heat transfer member 390 may flow upward through passageway 402, through orifice 404, and out through jet tube 406, where the fuel vapor is mixed with air. As shown in FIG. 11, a combustible mixture of air and fuel vapor may exit jet tube 406 while flowing toward the left and impinge upon a flame shaper 408. Flame shaper 408 may divide this gas flow into two portions, e.g. equal portions, to either side, and may generally reverse its direction so that the flow moves toward the right. After division and redirection, the flow of combustible mixture burns and makes flames, which may heat the lower surface 264 of valve plate 260. At the same time, flame shaper 408, which may be fixedly connected to the upper end of wick tube 386, may capture some of the heat from the combusted starter fuel vapor and return it back to starter heat transfer member 390. Retaining clip 398 holds spring bar 396, plunger 392, and wick tube 386 in place relative to sheath 382.

During operation of starter assembly 380, flame shaper 408 may be momentarily depressed after rotating control shaft 310 rotates valve plate 260, and with it starter guard 267 is away from flame shaper 408. Depressing flame shaper 408 usually causes wick tube 386, and with it plunger 392, to move downward within sheath 382 against the resistance offered by spring bar 396. When plunger 392 is moved downward, O-ring 394 may no longer block fuel inlet 397, thus allowing fuel 358 from fuel reservoir 350 to flow upward into fuel chamber 400. Once flame shaper 408 is released, wick tube 386 and plunger 392 may return upward, sealing O-ring 394 may be against fuel inlet 397 and predetermined amount of fuel may be trapped into fuel chamber 400. The fuel trapped may be transported upward under capillary action by starter wick 388, until the liquid fuel reaches the upper end of starter wick 388 in the vicinity of starter heat transfer member 390.

A flame source may then directly be applied to flame shaper 408, which may transfer the heat of the flame source to starter heat transfer member 390. Starter heat transfer member 390 may transfer the heat to the upper portions of starter wick 388, increasing the temperature of the transported liquid fuel contained within the upper portion of starter wick 388. When the temperature of this liquid fuel reaches the boiling point for the prevailing pressure, the liquid fuel begins to boil. The fuel vapor produced may travel upward through the slots and channel in starter heat transfer member 390, through passageway 402 and orifice 404, and out through jet tube 406, whereupon it will mix with air and be ignited by the external flame source being applied to flame shaper 408. Once this ignition occurs, the flame source being applied to flame shaper 408 may be removed, since a portion of the heat released by the ignited fuel vapor will be returned through the flame shaper 408 back to starter heat transfer member 390 to produce a self sustaining capillary feed boiling action.

Flame shaper 408 may direct the flame produced by the combusted starter fuel vapor upward on to valve plate 260, which, in turn, may transfer the heat through orifice plate 250 to heat transfer member 230 to begin the main capillary feed boiling action in capillary member 220. Once the fuel vapor produced by capillary member 220 exits jet orifices 278, that fuel vapor may mix with air and be ignited by the flame from starter assembly 380 being directed upward by flame shaper 408. Heat return tabs 290 may return sufficient heat from the flames produced at jet orifices 278 to sustain the capillary feed boiling action in capillary member 220. Once the liquid fuel in fuel chamber 400 has been exhausted by the combustion in the starter assembly 380, starter assembly combustion may cease. Fuel chamber 400 may provide sufficient fuel for commencing a self-sustaining capillary feed boiling action in capillary member 220 before the combustion in starter assembly 380 ceases.

Referring to FIG. 10, support prongs 360 may provide a surface for setting the cooking pan or other item to be heated by the stove. Support prongs 360 may be bent metal tabs fixedly attached to boiler frame 214. Top 370 may also be provided and sized to accommodate the outer circumference of fuel reservoir 350 forming an enclosure for easy transportation of the stove. Handle 372 may permit top 370 to function as a cooking pot when inverted.

During operation of the stove, liquid fuel 258 may be added to fuel reservoir 350 by unscrewing boiler frame 214 and associated apparatus from fuel reservoir lid 352 at threads 216 to expose the interior of fuel reservoir 350. Liquid fuel may be added through the void left in lid 352 by the removed boiler frame 214. A sufficient amount of liquid fuel 358 is often added so that when boiler frame 214 is reinstalled, ends 244 of supply wick 240 and plunger 444 will be submerged in fuel. Boiler frame 214 may be screwed back into place in lid 352 of fuel reservoir 350 until O-ring 218 is firmly compressed between boiler frame 214 and fuel reservoir lid 352, providing a tight seal between the interior of the fuel reservoir and atmosphere.

Knob 314 may be turned counter, such as in a clockwise direction, to rotate control shaft 310, and with it pinion gear 316 so that face gear 294, and with it valve plate 260, rotate clockwise as seen from above about screw 288 to open a fluid communication path between capillary member 220 and jet former 270. As valve plate 260 rotates, starter guard 267 may move with it to expose flame shaper 408 on starter assembly 380. As control shaft 310, and with it pinion shaft 317, rotate, tip 332 of vent piston 330 may disengage from detent 320 and move counter clockwise along concentric cam slot 318 in pinion shaft 317. This movement may cause vent piston 330 to move downward against spring clip 247 and open an air path from atmosphere through vent shaft 336 and into gas space 354 of fuel reservoir 350. The fluid communication path thereby created may provide a means for air from the atmosphere to move into gas space 354 to fill the void created by the liquid fuel, which is consumed as the boiler operates.

Next, flame shaper 408 of starter assembly 380 may be depressed through wick tube 386, plunger 392 and associated components downward against the resistive force of spring bar 396. This action will usually open fuel inlet 397 and allow liquid fuel 358 in fuel reservoir 350 to flow upward into fuel chamber 400. Flame shaper 408 may be momentarily held down to allow fuel chamber 400 to fill. When flame shaper 408 is released, it, along with wick tube 386, plunger 392, and associated apparatus may move upward, sealing off fuel inlet 397 with O-ring 394. A few seconds delay may give time for the liquid fuel in fuel chamber 400 to be transported via capillary action by starter wick 388 upward into the vicinity of starter heat transfer member 390. Then, an external flame source may be applied to flame shaper 408 to heat it and concomitantly starter heat transfer member 390 to begin the boiling of the liquid fuel in starter wick 388. When fuel vapor exits jet tube 406 and mixes with air, it may be ignited by the external flame source to begin self-sustaining combustion and capillary feed boiling of the starter assembly 380.

The combustion-flame produced by starter assembly 380 may be directed upward and inward by flame shaper 408 and impinge against the adjacent portions of valve plate 260, heating it. This heat may be transferred through valve plate 260, orifice plate 250, and heat transfer member 230 into capillary member 220.

When the liquid fuel within capillary member 220 is heated to its vaporization temperature for the extant capillary pressure, the fuel boils and the released fuel vapor escapes upward through the remainder of capillary member 220, such as through notches 236 and channel 238 in heat transfer member 230, through apertures 256 and orifice plate 250, through ports 268 and valve plate 260 and into jet former 270, where it finally escapes through jet port 278. Upon exiting jet port 278 and mixing with air, the released fuel vapor may be ignited by the flame from starter wick 340, thus starting the stove. Once the stove has been started, some of the heat from flames 284 may be transmitted via valve plate 260, orifice plate 250 and heat transfer member 230 to capillary member 220 to sustain the boiling process.

At higher stove outputs, determined by the position of valve plate 260 relative to orifice plate 250, flames 284 may extend a sufficient horizontal distance from jet port 278 to impinge upon heat return tabs 290 and thus provide additional heat transfer back to capillary member 220 to sustain higher boiling rates necessary for higher fuel vapor production rates. Heat return tabs 290, as well as the other transfer components of the device, may empirically permit a desired amount of heat to be transferred to capillary member 220 to sustain the boiling.

Once the stove is operational, a cooking pan or other item to be heated may be placed atop spider 360. As the cooking or other heating progresses, knob 314 may be used to rotate control shaft 310 as appropriate to throttle the flow of fuel vapor through valve plate 260 and into jet former 270, thus regulating the output of the stove. As different amounts of fuel vapor flow are demanded from the boiler, the heat transfer through heat transfer member 230 and into capillary member 220 may automatically adjust to sustain boiling.

Figure 22:
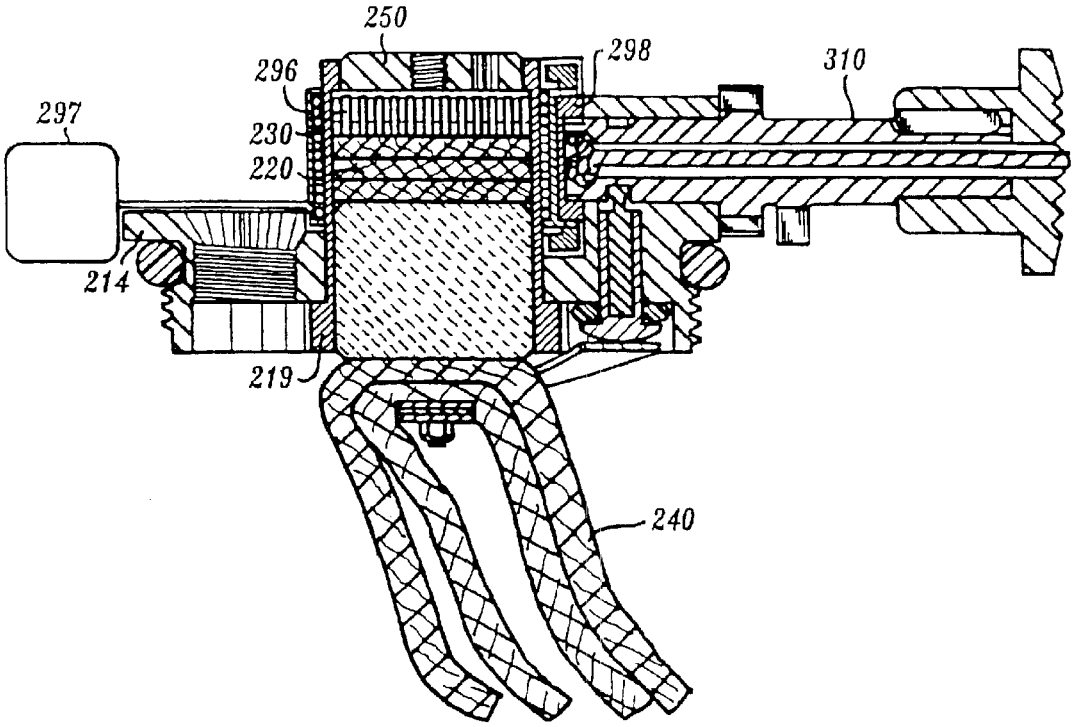
FIG. 22 is a side sectional elevational view of another embodiment of the invention.

Another embodiment of the liquid fuel stove employing a capillary feed boiler is depicted in FIG. 22. In this embodiment, heat return bars 290 are replaced by resistive heat elements 296 that may be attached to shroud 219, and powered by battery 297. Other embodiments may employ a variety of other electrical power sources. In this embodiment, some heat from combustion may inadvertently reach the boiler by stray conductive, convective, and radiative heat paths. Resistive heat elements 296 may add to this stray heat enough to maintain vapor flow. The electrical heat may be controlled electronically to maintain the heat transfer member at a controllable temperature. The temperature of heat transfer member 230 may be sensed by the resistance of the heat elements 296 using well-known electronic control techniques. This temperature may be controlled manually, for example, with a knob.

This embodiment of the invention may not require a vapor valve and vapor may flow unimpeded from the boiler to the jet forming orifices. The vapor flow depends upon the heat input to the boiler, which in turn depends upon the temperature of the heat transfer member. Therefore, the combustion output may depend upon the controllable temperature of the heat transfer member.

Further to this the embodiment, control of the combustion output may be achieved by throttling the fuel vapor flow by changing the relative positions of orifice plate 250 and valve plate 260. Once valve plate 260 is rotated into an open position relative to orifice plate 250, valve plate 260 may remain fixed, and stove output may be controlled by controlling the heat output of resistive heat elements 296 and hence the boiling rate in capillary member 220. Rheostat 298, attached to and manually controlled by the rotation of control shaft 310, may be provided to vary the electrical supply to resistive heat elements 296, and hence the heat output of the heat elements. The result may be an exacting method of controlling the output of the stove for applications in which accurate control is desired. Remaining portions of the camp stove of this alternative embodiment, such as jet former 270, vent piston 330 and starter wick 340, may be similar to those of the previously described embodiment.

There are various different methods in which a vaporization module may be made. While certain steps and materials are described herein, these are exemplary and methods of the making present invention are not limited to these particular embodiments.

One method for producing the capillary member of the present invention involves mixing solids particles having a small and generally uniform average diameter with a solvent and an appropriate binder. The particle size of the raw material solids particles may be desirably smaller than the desired pore size of the finished high porosity material. Usually, relatively large and thick pieces can be prepared without pore collapse.

In general, base material particulates are mixed with a solvent or a solvent system that is capable of serving as a solvent for a binder under a first set of environmental conditions and that is capable of changing its solvency as a result of changed environmental conditions. The base material particulates are thoroughly mixed with the solvent system and a binder is added under conditions in which the solvent system acts as a solvent for the binder. Solids particles are usually of generally uniform size and are uniformly coated with the solvent and the binder. The solvency of the solvent system is then shifted so that the solvent system is no longer a solvent for the binder and the matrix consequently gels or hardens. The shift in solvency may be produced by changing temperature or making another change in the environment, depending on the nature and type of the solvent system and the binder. The matrix is then further hardened, if necessary, and the hardened material is dried, such as by supercritical $CO_2$ solvent replacement. The dried material is then sintered to provide the high porosity material of the present invention.

In one specific method, solids particles are thoroughly mixed with a solvent or solvent system and binder in a manner that thoroughly wets the solids particles and prevents agglomeration of the solids particles. For example, the solids particles may be mixed with a solvent or solvent system in a mixing apparatus, such as a ball mill, prior to addition of the binder. Mixing and milling may take place over any period of time, e.g. from several minutes to several hours. The raw material solids particles may be ground to provide smaller particle sizes during or prior to addition of the solvent system. The binder may be added and the solids/solvent/binder matrix thoroughly mixed, such as in a ball mill, over a convenient period of time, e.g. from several minutes to several hours. The solids/solvent/binder mixture thus produced is often in the form of a low viscosity slurry. According to one embodiment, the solids particles comprise a "pure" material such as zirconia, alumina, or the like. According to another embodiment, raw material solids particles of two or more materials may be mixed.

The solids particles, the solvent or solvent mix, and the binder may be selected depending upon, inter alia, the desired properties of the produced material and affinity for the desired solids particles. The volumetric ratio of solids to binder may be any desired amount, e.g. less than about 5:1 and/or more than about 1:1 and more often about 1.5:1. An example of the volumetric ratio of liquid to solids in the solids/solvent/binder mixture is less than about 30:1 and/or more than about 2:1, more often about 20:1.

The solvent system may be a single component solvent or a solvent mix in which the solvent system is a solvent for the binder at one predetermined environmental condition and a non-solvent at another predetermined environmental condition. The solvent system may be a solvent for the selected binder at one temperature, for example, and a non-solvent for the selected binder at another temperature. The solvent system may thus be manipulated, by changing an environmental condition such as temperature, to change the physical structure of the solids/solvent/binder matrix.

Cellulose acetate is one binder that may be used, for example, with zirconia ceramic particles. Acetone/methanol may be an appropriate solvent system for use with a cellulose acetate binder add at a ratio of acetone to methanol in which the organic solvent system is barely a solvent for the binder at a first environmental condition, e.g., ambient temperature. Other solvent systems include acetone and various alcohol components (methanol, ethanol, isopropyl alcohol, etc. for cellulose acetate binders); methanol, ethanol, acetone, etc. for cellulose nitrate binders; amine solvents and kerosene for polypropylene or polyethylene; and numerous other suitable binders and solvent systems known or will be known in the art.

The low viscosity solids/solvent/binder mixture may be transferred to a mold and one or more environmental condition(s) may be changed to shift the solvency of the solvent system. For example, the matrix and the mold may be chilled to shift the solvency of the acetone/methanol solvent system and to provide a gelled, or hardened matrix. The gelled material may be treated to remove one of the components of a multiple component solvent system. In one embodiment that employs an acetone/methanol solvent system, the gel may be submerged in chilled methanol, and, the acetone component of the solvent system replaced by methanol over a time period, such as over the course of several days. The solvent substitution is typically accompanied by a hardening of the matrix.

The hardened material may be dried using any suitable means, e.g. by supercritical $CO_2$ solvent replacement, in which, the temperature and pressure of the material retained in the mold in a pressurizable vessel, is adjusted to provide a slow transition from liquid to supercritical to gaseous phases. The drying may prevent the simultaneous existence of liquid and gas phases, thereby eliminating capillary action and consequential collapse of pores in the weak material. In one protocol, $CO_2$ continually flows over a significant time period to ensure complete removal of the solvent, e.g. methanol, prior to the transition to the gas phase. A pressure vessel may be used, having at least about 5 times the interior volume of the volume of samples being dried. The vessel may be filled with liquid $CO_2$ and the temperature slowly raised over a period of a few hours while releasing pressure to maintain a constant pressure of about 2000 psi. After filling, no additional $CO_2$ may be added to or flowed through the vessel. The temperature may be raised to about 90° C. and venting continued until the pressure is reduced to 0 psi, while maintaining temperature. Yet another technique for drying the hardened matrix includes applying an anti-wetting agent, followed by utilization of conventional drying techniques.

Alternatively, a solvent system may be used where cold liquid $CO_2$ at high pressure is the non-solvent component and is later made supercritical for removal. An exemplary procedure includes mixing cellulose acetate, acetone, and ceramic and pouring the mixture into a mold. The mixture may be slowly pressurized with $CO_2$ at 20° C. to 900 psi. Diffusion of $CO_2$ into the mixture may cause the solvency to shift towards non-solvency. The temperature and pressure may be held for 8 hours and then the temperature ramped to 90° C. over a 4 hour period while limiting pressure to 2000 psi. The mixture may be slowly vented to atmospheric over a 4 hour period.

Following the drying, the material may be sintered at the temperature and time readily determined by one skilled in the art, for example, at 1050° C. for 4 hours for zirconia material. The material may be placed in a silicon carbide box to assist in providing a uniform temperature, and the temperature ramped during heating and cooling cycles. Various sintering techniques may be applicable to the materials used, which may be determined by means of routine experimentation.

The sintered, high porosity material may be abrasive and somewhat powdery. In some embodiments, it may be made into sheets and cut to size, for example, using standard metal cutting equipment, such as saws, lathe tools, milling tools, drills and the like, and with hard blades, such as carbide materials. The high porosity material may be saturated with stearic acid to improve the machining and handling properties. It may be vacuum impregnated with hot, liquid stearic acid, cooled, machined, baked clean at 500° C., and polished flat on both sides with a flat diamond disk operated under running water. The machined and polished pieces may then be dried prior to use.

A block of the sintered capillary member material, e.g. zirconia may be placed under vacuum and impregnated with hot liquid stearic acid. The capillary member material may be removed from the acid, excess liquid removed and cooled to 25° C. The cooled, impregnated capillary member material may be mounted on a flat aluminum plate using molten microcrystalline wax and machined flat by removing about 25% of the material thickness. In addition, circular plugs may be produced using a trepanning tool, e.g. to a depth of 0.150. The material may be remounted with the flat side down, milled to a thickness of 0.135, and the plugs removed upon heating. A circular plug may be baked, for example, at 500° C. for one hour, to remove the stearic acid. The capillary member may be polished such as by using a flat diamond disk under running water, and dried in an oven to remove moisture.

The liquid feed element and heat transfer member element of the vaporization module may be fabricated from alumina grindstone. The material may be roughly cut into discs or other desired shapes, such as with a diamond saw, and dried at 500° C. The cut material may be vacuum impregnated with epoxy to prevent damaging the diamond polishing wheel and mounted on a mandrel for grinding and cutting. The discs may be ground on a lathe with high speed diamond tools to a desired size, e.g. diameter of 0.500 inch. Liquid feed disks may be cut from a rod of material to any thickness, e.g. 0.165 inch. A small diameter longitudinal bore may be cut into the remaining portion of the rod and heat transfer member discs having a central bore or orifice may be cut off the remainder of the rod, for example, to a thickness of 0.050 inch. Both liquid feed discs and heat transfer member discs may be polished flat on a diamond disk and heated to bum out the epoxy, e.g. at 500° C. for one hour. Orifice plates that have generally high strength and durability, smooth, flat surfaces, and a high thermal conductivity may produced from ceramic materials by conventional dry-pressing techniques generally known by those skilled in the art.

The weight of the dried material may be measured and placed in a ball mill to mix with a mixture of isopropyl alcohol equal to about the dry weight of the material with stearic acid equal to about 0.1363 of the dry weight material (12% by weight) that had been heated until dissolved. The ball mill may be run a convenient period of time, such as 1 hour, and the slurry removed, using additional isopropyl alcohol, as necessary, to remove solids from the mill. The slurry may be mixed with 10 g ammonium hydroxide and the resultant material dried in the double boiler, followed by complete drying in the oven. The dried material may be ground with a mortar and pestle and screened to a desired size, e.g. 0.0035 inch.

The orifice disks may be formed by molding. For example, molds may be coated with a CN and Amyl mixture and completely dried. An amount of the powder mixture, e.g. 2 g in a 1.00 inch diameter mold, may be loaded into the mold and the mold closed. The mold may be heated on a hot plate until the stearic melts and the mold is pressed at 7500 pounds. After cooling, the molded ceramic disc may be removed from the mold and the flat surfaces and outer diameter ground in a lathe. The discs may be placed in a SiC box for uniform sintering. The temperature may be ramped to 500° C. over 4 hours, held at 500° C. for one hour, then ramped to 1350° C. over one hour and held at 1350° C. for one hour and then cooled by ramping to 0° C. over 2 hours. The sintered orifice discs may be polished flat on both flat surfaces and cleaned.

For the sealing member, a low thermal conductivity glaze that is impermeable to liquids and gases may be formulated to coat peripheral edges of the vaporization module and to hold the components together. For example, the glaze may be made by mixing 100 g Ferro frit 3195, 2 g boric acid, 2 g red food coloring and 200 g methanol in a ball mill and grinding for two hours. The slurry may be dried in a double boiler, followed by complete drying in an oven. A "small CN mix" may be made by mixing 10 g cellulose nitrate (Aldrich, 43,508-2) with 60 g amyl acetate. A "big CN mix" may be made by mixing 3 g cellulose nitrate (Aldrich 43,505-8) with 60 g amyl acetate. Both formulations may be thoroughly mixed and allowed to stand overnight. The resulting dry powder, e.g. 15.64 g, may be mixed with amyl acetate, e.g. 20 g, and ground with a mortar and pestle. The big CN mix, e.g. 5.75 g and small CN mix, e.g. 5.75 g may be also mixed with the mixture.

Assembly of the vaporization module may include aligning a heat transfer member element, capillary member disc and liquid feed disc in free rotation fixture in a lathe under light pressure. The assembly may be spun at low speed and one or more coats, e.g. three coats, of the glaze glass may be applied to the cylindrical exterior surface of the aligned components of the vaporization module. The glaze may be applied slightly over the end edges and hot air directed to the assembly to assist in drying. The glazed assembly may be baked in a furnace, e.g. at 800° C. for 5 minutes. The orifice plate may be joined to this assembly, for example, by applying a small amount of glaze glass at the joint only and baking at 800° C. for 5 minutes. The assembly may also be vacuum impregnated with Silane mix and dried at 75° C. for 3 hours.

One embodiment of vaporization module produced by these methods may have various sizes, such as from 0.2 to 0.8 inches in diameter and are 0.4 inches in height. An exemplary vaporization module that has a diameter of ½ inch may produce vapor at flow rates of 1.35 grams of fuel per minute. In general, the flow rate may be proportional to the cross-sectional surface area of the module.

The present invention has been described above in varied detail by reference to particular embodiments and figures. However, these specifics should not be construed as limitations on the scope of the invention, but merely as illustrations of some of the present embodiments. It is to be further understood that other modifications or substitutions may be made to the described the vaporization module, as well as methods of its use without departing from the broad scope of the invention. Therefore, the following claims and their legal equivalents should determine the scope of the invention.

We claim:

1. A vaporization module to create pressurized vapor, comprising:

a capillary member comprising a low thermal conducting material having small-sized pores, wherein the capillary member transforms liquid into vapor towards a vaporization zone by heat migration;

an orifice plate having one or more orifices to permit release of pressurized vapor; and a sealing member to form, in association with the orifice plate, an at least partial enclosure of the vaporization module in which vapor pressure may increase.

2. The vaporization module of claim 1, wherein the pores of the capillary member are substantially uniform in size.

3. The vaporization module of claim 1, wherein the low thermal conducting material is ceramic.

4. The vaporization module of claim 1, further including a porous heat transfer member to provide heat to the capillary member.

5. The vaporization module of claim 1, further including a porous liquid feed member to provide liquid to the capillary member.

6. The vaporization module of claim 1, wherein the sealing member is spaced away from the capillary member to form a vapor collection space.

7. The vaporization module of claim 1, further including a valve or throttle to regulate the release of vapor.

8. The vaporization module of claim 1, further including a burner assembly for mixing the released vapor with gas.

9. A method for producing pressurized vapor from non-pressurized liquid, in a vaporization module, comprising:

providing liquid to a vaporization zone of a capillary member having small-sized pores and being at least partially enclosed by a sealing member;

allowing the liquid to travel within the pores of the capillary member;

providing heat to the vaporization zone to convert the liquid into vapor;

accumulating the vapor to increase pressure; and releasing the vapor from the vaporization module through an opening in an orifice plate.

10. The method of claim 9, further including combusting the released vapor.

11. The method of claim 9, wherein the heating includes an initial heating from an external source and thereafter heating from a returned heat of the combustion.

12. The method of claim 9, wherein the released vapor has a greater pressure than the provided liquid.

13. The method of claim 9, wherein the vapor is released with sufficient velocity to mix with gas.

14. The method of claim 9, wherein the location of the vaporization zone is stabilized through counter balance of accumulation of the heat and the traveling liquid.

* * * * *